US009542810B2

(12) United States Patent
Gilmore et al.

(10) Patent No.: US 9,542,810 B2
(45) Date of Patent: Jan. 10, 2017

(54) GAMING MACHINE AND METHODS OF PROVIDING GAMES TO PLAYERS HAVING DICE WITH EXPANDABLE IMAGES

(71) Applicant: KONAMI GAMING, INC., Las Vegas, NV (US)

(72) Inventors: Jason Gilmore, Las Vegas, NV (US); Jayme Neverton, Las Vegas, NV (US); Ali Minaian, Las Vegas, NV (US); Carolyn Tomczyk, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/856,151

(22) Filed: Sep. 16, 2015

(65) Prior Publication Data

US 2016/0078714 A1 Mar. 17, 2016

Related U.S. Application Data

(60) Provisional application No. 61/051,619, filed on Sep. 17, 2014.

(51) Int. Cl.
*G07F 17/32* (2006.01)
*G07F 17/34* (2006.01)

(52) U.S. Cl.
CPC ..... *G07F 17/3267* (2013.01); *G07F 17/34* (2013.01)

(58) Field of Classification Search
USPC ..... 463/20, 22
See application file for complete search history.

(56) References Cited

U.S. PATENT DOCUMENTS

| | | | | |
|---|---|---|---|---|
| 6,386,973 | B1 * | 5/2002 | Yoseloff | F24F 7/02 454/358 |
| 8,096,869 | B2 | 1/2012 | Yoshimi | |
| 9,047,741 | B2 | 6/2015 | Suda | |
| 9,336,651 | B2 * | 5/2016 | Owen | G07F 17/3244 |
| 2015/0235519 | A1 * | 8/2015 | Owen | G07F 17/3244 463/25 |

FOREIGN PATENT DOCUMENTS

JP 20050124922 A 11/2006

OTHER PUBLICATIONS

Australian Patent Examination Report No. 1 dated Nov. 12, 2015 for AU Patent Application No. 2015227447.
Australian Patent Examination Report No. 1 dated Nov. 12, 2015 for AU Patent Application No. 2015227449.

* cited by examiner

*Primary Examiner* — Pierre E Elisca
(74) *Attorney, Agent, or Firm* — Howard & Howard Attorneys PLLC

(57) ABSTRACT

A gaming machine for providing a game to a player is described herein. The gaming machine displays a primary game including a plurality of reels, detects a triggering condition occurring with the primary game and responsively displays a secondary game. The secondary game includes a player character and an enemy character being displayed on an animated game field. The gaming machine displays a plurality of dice on the animated game field including a player die displayed with a player strength value and an enemy die displayed with an enemy strength value. The gaming machine displays an expandable image of the player strength value at a first size and increases the size of the expandable image to a larger second size over a predefined period of time.

20 Claims, 27 Drawing Sheets

232

| Set Level 1 | End Chance | Chance Given Lose |
|---|---|---|
| Battle 1 | 17.500% | 0.0% |
| Battle 2 | 30.525% | 0.0% |
| Battle 3 | 25.988% | 7.8% |
| Battle 4 | 13.597% | 6.8% |
| Battle 5 | 8.209% | 5.7% |
| Battle 6 | 2.906% | 2.6% |
| Battle 7 | 0.969% | 1.0% |
| Battle 8 | 0.253% | 0.3% |
| Battle 9 | 0.044% | 0.0% |
| Battle 10 | 0.002% | 0.0% |

Figure 26

230

| | Secondary Award | Award Value | Award Selection Probability | | | |
|---|---|---|---|---|---|---|
| | | | Round 1 | Round 2 | Round 3 | Round 4 |
| 196 | MINI | $10.00 | 85% | 75% | 50% | 20% |
| 196 | MAJOR | $20.00 | 10% | 20% | 25% | 40% |
| 196 | MEGA | $100.00 | 4% | 4% | 10% | 30% |
| 196 | MAXI | $1,000.00 | 1% | 1% | 5% | 10% |

Figure 27

238

222

192

| Opponent Levels | | | | |
|---|---|---|---|---|
| | Opponent 1 | Opponent 2 | Opponent 3 | Win Chance |
| 1 | 0 | 0 | 0 | 100% |
| 2 | 0 | 0 | 0 | 95% |
| 3 | 1 | 0 | 0 | 90% |
| 4 | 1 | 0 | 0 | 85% |
| 5 | 1 | 0 | 0 | 80% |
| 6 | 1 | 0 | 0 | 75% |
| 7 | 1 | 0 | 0 | 70% |
| 8 | 1 | 0 | 0 | 65% |
| 9 | 1 | 0 | 0 | 60% |
| 10 | 0 | 1 | 0 | 55% |
| 11 | 0 | 1 | 0 | 50% |
| 12 | 0 | 1 | 0 | 45% |
| 13 | 0 | 1 | 0 | 40% |
| 14 | 0 | 1 | 0 | 35% |
| 15 | 0 | 1 | 0 | 30% |
| 16 | 0 | 1 | 0 | 25% |
| 17 | 0 | 0 | 1 | 20% |
| 18 | 0 | 0 | 1 | 15% |
| 19 | 0 | 0 | 1 | 10% |
| 20 | 0 | 0 | 1 | 5% |
| Win | 75.00% | 40.00% | 12.50% | |

Figure 28

228

226

| Player Bonus | Chance |
|---|---|
| 0 | 6.67% |
| +1 | 33.33% |
| +2 | 26.67% |
| +3 | 20.00% |
| +4 | 13.33% |
| | 100.00% |

Figure 29

224

192

194

| Player Strength Value | Enemy Strength Value | | | | | | | | | | | | | | | | | | |
|---|---|---|---|---|---|---|---|---|---|---|---|---|---|---|---|---|---|---|---|
| | 2 | 3 | 4 | 5 | 6 | 7 | 8 | 9 | 10 | 11 | 12 | 13 | 14 | 15 | 16 | 17 | 18 | 19 | 20 |
| 1 | 0.00% | 0.00% | 0.38% | 0.15% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% |
| 2 | 0.00% | 1.37% | 0.60% | 0.38% | 0.15% | 0.00% | 0.00% | 0.00% | 0.00% | 0.00% | 0.00% | 0.00% | 0.00% | 0.00% | 0.00% | 0.00% | 0.00% | 0.00% | 0.00% |
| 3 | 0.00% | 0.00% | 1.37% | 0.60% | 0.38% | 0.15% | 0.00% | 0.00% | 0.00% | 0.00% | 0.00% | 0.00% | 0.00% | 0.00% | 0.00% | 0.00% | 0.00% | 0.00% | 0.00% |
| 4 | 0.00% | 0.00% | 0.00% | 1.37% | 0.60% | 0.38% | 0.15% | 0.00% | 0.00% | 0.00% | 0.00% | 0.00% | 0.00% | 0.00% | 0.00% | 0.00% | 0.00% | 0.00% | 0.00% |
| 5 | 0.00% | 0.00% | 0.00% | 0.00% | 1.37% | 0.60% | 0.38% | 0.15% | 0.00% | 0.00% | 0.00% | 0.00% | 0.00% | 0.00% | 0.00% | 0.00% | 0.00% | 0.00% | 0.00% |
| 6 | 0.00% | 0.00% | 0.00% | 0.00% | 0.00% | 1.37% | 0.60% | 0.38% | 0.08% | 0.00% | 0.00% | 0.00% | 0.00% | 0.00% | 0.00% | 0.00% | 0.00% | 0.00% | 0.00% |
| 7 | 0.00% | 0.00% | 0.00% | 0.00% | 0.00% | 0.00% | 1.37% | 0.60% | 0.21% | 0.08% | 0.00% | 0.00% | 0.00% | 0.00% | 0.00% | 0.00% | 0.00% | 0.00% | 0.00% |
| 8 | 0.00% | 0.00% | 0.00% | 0.00% | 0.00% | 0.00% | 0.00% | 1.37% | 0.38% | 0.21% | 0.08% | 0.00% | 0.00% | 0.00% | 0.00% | 0.00% | 0.00% | 0.00% | 0.00% |
| 9 | 0.00% | 0.00% | 0.00% | 0.00% | 0.00% | 0.00% | 0.00% | 0.00% | 0.59% | 0.38% | 0.21% | 0.08% | 0.00% | 0.00% | 0.00% | 0.00% | 0.00% | 0.00% | 0.00% |
| 10 | 0.00% | 0.00% | 0.00% | 0.00% | 0.00% | 0.00% | 0.00% | 0.00% | 0.00% | 0.59% | 0.38% | 0.21% | 0.08% | 0.00% | 0.00% | 0.00% | 0.00% | 0.00% | 0.00% |
| 11 | 0.00% | 0.00% | 0.00% | 0.00% | 0.00% | 0.00% | 0.00% | 0.00% | 0.00% | 0.00% | 0.59% | 0.38% | 0.21% | 0.08% | 0.00% | 0.00% | 0.00% | 0.00% | 0.00% |
| 12 | 0.00% | 0.00% | 0.00% | 0.00% | 0.00% | 0.00% | 0.00% | 0.00% | 0.00% | 0.00% | 0.00% | 0.59% | 0.38% | 0.21% | 0.08% | 0.00% | 0.00% | 0.00% | 0.00% |
| 13 | 0.00% | 0.00% | 0.00% | 0.00% | 0.00% | 0.00% | 0.00% | 0.00% | 0.00% | 0.00% | 0.00% | 0.00% | 0.59% | 0.38% | 0.21% | 0.07% | 0.00% | 0.00% | 0.00% |
| 14 | 0.00% | 0.00% | 0.00% | 0.00% | 0.00% | 0.00% | 0.00% | 0.00% | 0.00% | 0.00% | 0.00% | 0.00% | 0.00% | 0.59% | 0.38% | 0.17% | 0.07% | 0.00% | 0.00% |
| 15 | 0.00% | 0.00% | 0.00% | 0.00% | 0.00% | 0.00% | 0.00% | 0.00% | 0.00% | 0.00% | 0.00% | 0.00% | 0.00% | 0.00% | 0.59% | 0.30% | 0.17% | 0.07% | 0.00% |
| 16 | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.47% | 0.30% | 0.17% | 0.07% |
| 17 | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.47% | 0.30% | 0.17% |
| 18 | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.47% | 0.30% |
| 19 | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.47% |
| 20 | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% | 0.00% |

Figure 30

GAMING MACHINE AND METHODS OF PROVIDING GAMES TO PLAYERS HAVING DICE WITH EXPANDABLE IMAGES

CROSS REFERENCE TO RELATED APPLICATION

This application claims priority to U.S. Provisional Patent Application Ser. No. 62/051,619, filed Sep. 17, 2014, the disclosure of which is hereby incorporated by reference in its entirety.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to gaming machines and more particularly, to gaming machines and method for allowing a player to play a video slot game having a bonus feature including dice having expandable images.

BACKGROUND OF THE INVENTION

Known gaming devices include a video display device to display a reel game that includes a plurality of reels with each reel including a plurality of symbols. During game play, the gaming device accepts a wager from a player, the player selects one or more paylines, the gaming device spins the reels, and sequentially stops each reel to display a combination of symbols on the reels. The gaming device then awards the player an award based on the combination of symbols orientated along the selected payline.

At least some known gaming devices include bonus feature games that may include additional free spins and/or progressive awards. Known gaming machines may include mystery bonus feature games that require the gaming machine to randomly select a bonus game number from a range of numbers, track each wager, increment a total wager amount based on each received wager, and initiate the bonus feature game when the total wager amount equals the bonus game number.

Overtime, players may become frustrated with known bonus feature games because the bonus feature games have limited player interaction and affect on the game outcome. In addition, at least some of the players are not eligible to receive the jackpot and each subsequent players success in obtaining the jackpot is based on the wagers of previous players. Accordingly, new features are necessary to appeal to player interest and enhance excitement in order to entice longer play and increased profitability. The present invention is directed to satisfying these needs.

SUMMARY OF THE INVENTION

In one aspect of the present invention, a gaming machine for providing a game to a player is provided. The gaming machine includes a display device and a controller coupled to the display device. The controller is configured to display a primary game on the display device including a plurality of reels and a plurality of symbols being displayed with the plurality of reels, randomly generate an outcome of the primary game and display the outcome on the display device, and detect a triggering condition occurring with the primary game and responsively display a secondary game on the display device. The secondary game includes a player character and an enemy character being displayed on an animated game field. The controller randomly selects a first random number from a predefined range of numbers and randomly selects a second random number from the predefined range of numbers. The first random number is associated with an enemy strength value of the enemy character and the second random number is associated with a player strength value of the player character. The controller determines an outcome of the secondary game including whether the player character defeats the enemy character as a function of the player strength value and the enemy strength value and provides an award to the player as a function of the outcome of the secondary game. The controller randomly selects the award from a set of secondary game awards. Each of the secondary game awards includes a different award value and an associated selection probability.

In another aspect of the present invention, a computer-implemented method of providing a game to a player via a gaming machine is provided. The gaming machine includes a display device and a gaming controller. The computer-implemented method includes receiving, by a gaming controller, a signal indicating a wager being placed by a player and responsively displaying a primary game on a display device. The primary game includes a plurality of reels and a plurality of symbols being displayed with the plurality of reels. The gaming controller randomly generates an outcome of the primary game and displays the outcome on the display device. The gaming controller also detects a triggering condition occurring with the primary game and responsively displays a secondary game on the display device. The secondary game includes a player character and an enemy character being displayed on an animated game field. The gaming controller randomly selects a first random number from a predefined range of numbers and randomly selecting a second random number from the predefined range of numbers. The first random number is associated with an enemy strength value of the enemy character and the second random number is associated with a player strength value of the player character. The gaming controller determines an outcome of the secondary game including whether the player character defeats the enemy character as a function of the player strength value and the enemy strength value and provides an award to the player as a function of the outcome of the secondary game. The gaming controller randomly selects the award from a set of secondary game awards. Each of the secondary game awards includes a different award value and an associated selection probability.

In yet another aspect of the present invention, one or more non-transitory computer-readable storage media, having computer-executable instructions embodied thereon, is provided. The computer-executable instructions cause a processor to display a primary game on a display device including a plurality of reels and a plurality of symbols being displayed with the plurality of reels, randomly generate an outcome of the primary game, and display the outcome on the display device. The processor detects a triggering condition occurring with the primary game and responsively display a secondary game on the display device. The secondary game includes a player character and an enemy character being displayed on an animated game field. The processor randomly selects a first random number from a predefined range of numbers and randomly select a second random number from the predefined range of numbers. The first random number being associated with an enemy strength value of the enemy character. The second random number being associated with a player strength value of the player character. The processor determines an outcome of the secondary game including whether the player character defeats the enemy character as a function of the player strength value and the enemy strength value and provides an award to the player as a function of the outcome of the secondary game. The processor randomly selects the award from a set of secondary game awards, each including a different award value and an associated selection probability.

In one aspect of the present invention, a gaming machine for providing a game to a player is provided. The gaming machine includes a display device and a controller coupled to the display device. The controller is configured to display a primary game on the display device including a plurality of reels and a plurality of symbols being displayed with the plurality of reels, randomly generate an outcome of the primary game, and display the outcome on the display device. The controller also detects a triggering condition occurring with the primary game and responsively displays a secondary game on the display device. The secondary game includes a player character and an enemy character being displayed on an animated game field. The controller displays a plurality of dice on the animated game field including a player die being displayed with a player strength value and an enemy die being displayed with an enemy strength value. The controller also displays an expandable image of the player strength value at a first size and increases the size of the expandable image to a larger second size over a predefined period of time. The controller also determines an outcome of the secondary game as a function of the player strength value and the enemy strength value and responsively provides an award to the player.

In another aspect of the present invention, a computer-implemented method of providing a game to a player via a gaming machine is provided. The gaming machine includes a display device and a gaming controller. The computer-implemented method includes receiving a signal indicating a wager being placed by a player and responsively displaying a primary game on a display device including a plurality of reels and a plurality of symbols being displayed with the plurality of reels. The gaming controller randomly generates an outcome of the primary game and displays the outcome on the display device. The gaming controller detects a triggering condition occurring with the primary game and responsively displays a secondary game on the display device. The secondary game includes a player character and an enemy character being displayed on an animated game field. The gaming controller also displays a plurality of dice on the animated game field including a player die being displayed with a player strength value and an enemy die being displayed with an enemy strength value and displays an expandable image of the player strength value at a first size and increases the size of the expandable image to a larger second size over a predefined period of time. The gaming controller also determines an outcome of the secondary game as a function of the player strength value and the enemy strength value and responsively provides an award to the player.

In yet another aspect of the present invention, one or more non-transitory computer-readable storage media, having computer-executable instructions embodied thereon, is provided. The computer-executable instructions cause a processor to display a primary game on a display device including a plurality of reels and a plurality of symbols being displayed with the plurality of reels, randomly generate an outcome of the primary game, and display the outcome on the display device. The processor detects a triggering condition occurring with the primary game and responsively displays a secondary game on the display device including a player character and an enemy character being displayed on an animated game field. The processor displays a plurality of dice on the animated game field including a player die being displayed with a player strength value and an enemy die being displayed with an enemy strength value. The processor also displays an expandable image of the player strength value at a first size and increase the size of the expandable image to a larger second size over a predefined period of time, determines an outcome of the secondary game as a function of the player strength value and the enemy strength value, and responsively provides an award to the player.

In one aspect of the present invention, a gaming machine for providing a game to a player is provided. The gaming device includes a display device for displaying a game, a user input device for receiving input from a player, and a controller coupled to the display device and the user input device. The controller is configured to display a primary game on the display device including a plurality of reels and a plurality of symbols being displayed with the plurality of reels. The controller randomly generates an outcome of the primary game, displays the outcome on the display device, and provides a primary award as a function of the outcome. The controller also detects a triggering condition occurring with the primary game and responsively displays a secondary game including a game board having a plurality of paths and a plurality of position locations defined along each of the plurality of paths. The controller determines a current player position within the game board and responsively displays a player symbol at the current player position. The current player position is associated with one of the plurality of position locations and is indicative of a previous position location of the player symbol at a completion of a previous secondary game.

In another aspect of the present invention, a method of providing an award to a player is provided. The method includes the steps of receiving a wager from a player and responsively displaying a primary game on a display device. The primary game includes a plurality of reels and a plurality of symbols being displayed with the plurality of reels. The method includes randomly generating an outcome of the primary game, displaying the outcome on the display device, and providing a primary award as a function of the outcome and the wager. The method also includes detecting a triggering condition occurring with the primary game and responsively displaying a secondary game including a game board having a plurality of paths and a plurality of position locations defined along each of the plurality of paths. The method includes determining a current player position within the game board and responsively displaying a player symbol at the current player position. The current player position is associated with one of the plurality of position locations and is indicative of a previous position location of the player symbol at a completion of a previous secondary game.

In yet another aspect of the present invention, one or more non-transitory computer-readable storage media, having computer-executable instructions embodied thereon, is provided. The computer-executable instructions cause a processor to display a primary game on a display device including a plurality of reels and a plurality of symbols being displayed with the plurality of reels, randomly generate an outcome of the primary game, display the outcome on the display device, and provide a primary award as a function of the outcome. The processor detects a triggering condition occurring with the primary game and responsively displays a secondary game including a game board having a plurality of paths and a plurality of position locations defined along each of the plurality of paths, determines a current player position within the game board, and displays a player symbol at the current player position. The current player position is associated with one of the plurality of position locations and is indicative of a previous position location of the player symbol at a completion of a previous secondary game.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 26-30 are exemplary illustrations of data records that may be used by the gaming device shown in FIG. 1, according to an embodiment of the present invention.

Corresponding reference characters indicate corresponding parts throughout the drawings.

DETAILED DESCRIPTION OF THE PREFERRED EMBODIMENT

Figure 1:
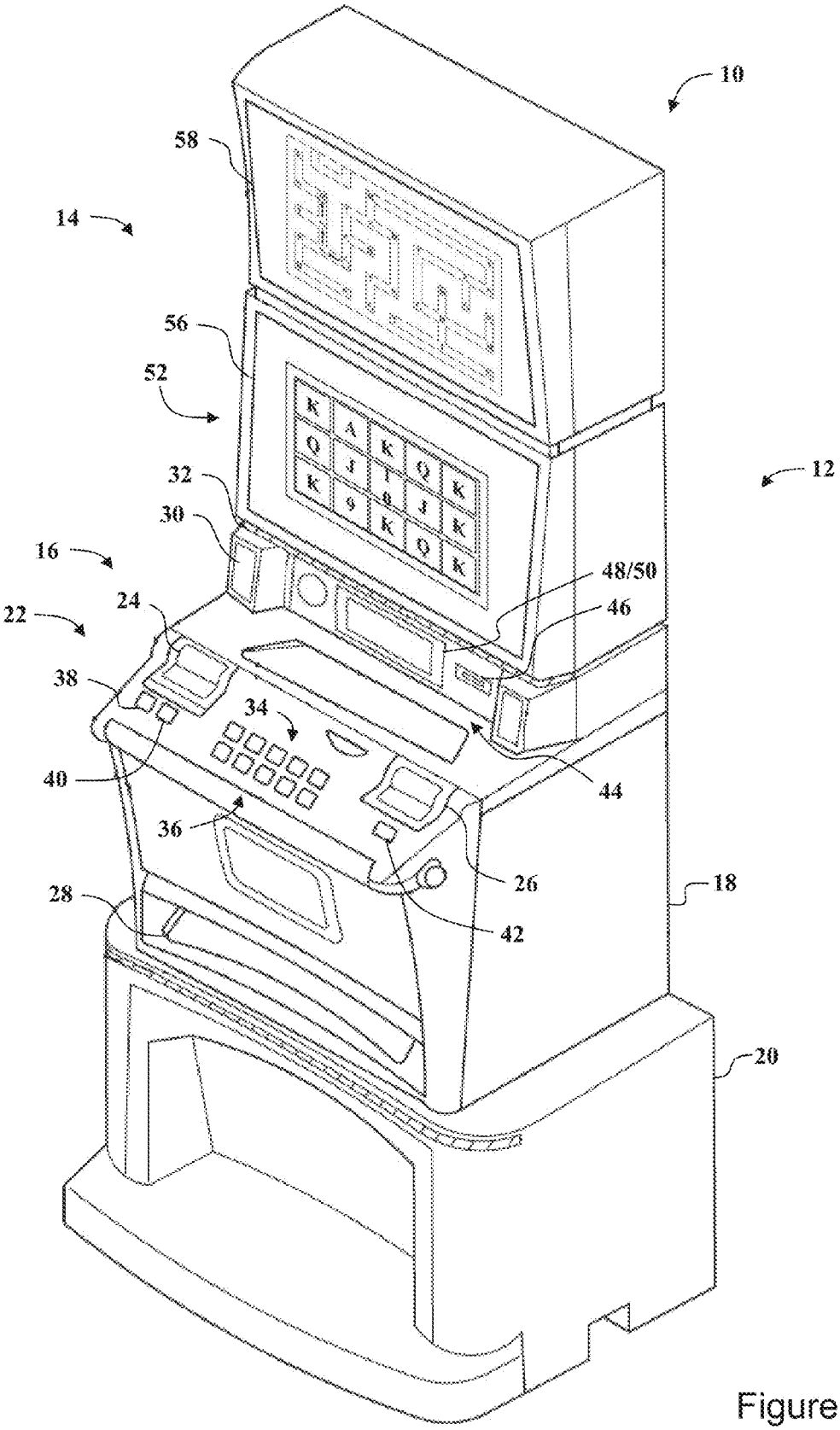
FIG. 1 is a perspective view of an exemplary gaming device for use in providing a game to a player, according to an embodiment of the present invention.

With reference to the drawings and in operation, the present invention overcomes at least some of the disadvantages of known gaming systems by providing a gaming machine that provides a bonus game that includes a player character and an enemy character, randomly assigns strength values to the player and the enemy character, and determines an outcome of the bonus game as a function of the corresponding strength numbers. In addition, the gaming machine displays the game with player dice and enemy dice that are animated to display the corresponding strength values. Once the values are displayed, the gaming machine modifies an image of the player strength value to increase its size to notify the player of the selected value.

The gaming machine may provide a battle game that includes battling enemy monsters by using dice. When the player enters the Enemy Battle, two dice (one representing the player's character and one representing the enemy) appear on the top screen. The dice then animate down to populate the interface on the bottom of the top screen and then copy and paste themselves to the interface on the bottom screen. The value of the enemy's strength—shown numerically—is on the enemy's dice during this process. Comparing values of two dice and seeing which is larger. If the player's number ties or is greater than the enemy's number, the player wins and in turn upgrades the potential prize available for the player to win.

In addition, the gaming machine may implement a 20 Sides Dice Roll Methodology (with Sequential/Linear Count Up). When the player rolls their die, visually, a random roll is generated. In certain cases, randomly, an added "Attack Bonus" of +0-+4 will be applied to the dice. This occurs if the player's dice value stops near or below the value of the opponent's strength value and needs that extra "push" to try and pass the enemy's value. It should be noted that this power up value will not always be successful when awarded.

The gaming machine may also display dice numeric value shown larger than the dice surface. Values facing the player on a 20 sided die are hard to see since each numeric surface [side] of the die is small. Displaying the numeric value of the die in a larger (font) size after the outcome—one that breaks the edges of the triangular sides of the surface—helps display the number better.

In addition, the gaming machine provides a bonus game that allows a player to interact with a player symbol to select one or more bonus awards and that increased the probability of winning an award by providing persistent player positions with subsequent bonus games. Moreover, the gaming machine provides a game that includes a plurality of game symbols positioned throughout a game maze and allows a player to move a player symbol through the game maze to acquire game symbols. The gaming machine also provides an award to the player as a function of the acquired game symbols. In addition, upon completion of the bonus game, the gaming machine stores the current location of the player symbol for use in a subsequent bonus game. By providing a bonus game that includes a plurality of game symbols that are acquired by the player to obtain associated awards, and that stores the location of the corresponding player symbol for use in subsequent games, the probability of the player receiving an award is increased. Thus, the amount of time that the gaming devices are played by patrons of a gaming establishment is thereby increased.

In general, present invention includes a gaming device that is configured to provide a primary base game and a secondary bonus game. The secondary bonus game is mystery triggered, meaning it can occur after any bought base game. When triggered, the game device displays a transition screen to the bonus game displays the bonus game including player character being displayed on a virtual game board. The players start the bonus on the virtual game board shown from the perspective of a "top down" view. The player's character is shown on the board in the center of a bottom screen. Directional arrows are shown around the character (only in the directions in which the character can move). When players select a direction to move their character on the game board, the board dynamically scrolls with a short delay either left, right, up, or down so the player's character is always nearly centered on the screen. One of the following events is shown to the player during or after the character moves: 1) discover an artifact/treasure, awards credits, and continue play; 2) discover a trap and end bonus game; and 3) discover an enemy and trigger jackpot decision bonus feature. The Discover an Artifact/Treasure includes a quick animation of the object appearing on the game board shows along with a winning amount of credits. Credits are then counted in the bonus meter and players select another game board location to move to. Discover a Trap. Finding a trap and playing a short animation that shows the player that the bonus round has ended. The last position on the game board that the player's character was located in is saved and used as the starting point for when the next mystery bonus game is triggered. A quick flame transition then brings the player back to the primary game screen.

Discover an Enemy: when a monster is discovered, a progressive jackpot win is guaranteed. The last position on the game board that the player's character was located in is saved and used as the starting point for when the next mystery bonus game is triggered. The game transitions to a battle scene where the player's character must fight an enemy. Losing against the enemy ends the fighting portion of the bonus and sends the player to the Jackpot Decision bonus. Defeating a enemy awards an upgrade that is applied to the Jackpot Decision bonus. When fighting an enemy, one roll of a pair of dice occurs. The value that the player rolls must tie or exceed the value the enemy has in order to win. The enemy has a predetermined value (number); the higher the number, the more difficult it is to defeat the enemy. Defeating the enemy awards an upgrade and triggers another battle where the above process is repeated with a different monster. The longer the player is in the fighting portion of the bonus, the more the player collects upgrades to be used in the Jackpot Decision bonus.

Jackpot Decision Bonus. This bonus actually occurs simultaneously with the enemy fighting bonus, but it is secondary until the player is defeated by an enemy. When players are fighting an enemy, they will likely notice the colored bonus prize "wheel" on the battle floor. This is the progressive wheel and contains all possible winning values in the progressive decision game. When players defeat an enemy, the progressive wheel will upgrade. The upgrade will be visually shown to the player. Players continue bonus play against enemies, and the progressive wheel will upgrade every time they defeat an enemy; they will visually be able to tell that their potential ending prize is increased. Play continues until the player is defeated by an enemy.

When defeated by an enemy, the enemy disappears and the camera view changes to a top-down view of the floor; a wheel pointer appears and the progressive wheel then "activates" and spins, slowing to a stop. The progressive level prize the pointer points to is awarded to the player and short celebration plays; the bonus game then ends.

Saving game board position—initial game play setup. During a first bonus event, a player moves a character on a game board to various position locations, such as positions A, B, C, and D on the game board. When the first bonus event ends, the current player location, i.e. location D is stored for use in a subsequent bonus game. When the next bonus event is triggered, after n number of games later, the player starts the bonus with the character at position 'D' (from the previous bonus) on the game board and continues the bonus from that point onward. The only persistent state function in the game would be where the player starts the bonus on the game board; nothing else. Each bonus event may be completely independent, meaning, prizes/events on the game board are not held consistently between bonus events (though the same prize could end up at the same location via randomness). Each time the game board event is triggered, the prizes/events populate the game board at random. Therefore, every bonus event (aside from the player's starting position) is completely independent of the prior bonus event.

In addition, the game symbols indicative of potential bonus outcomes change locations in some instances and some remaining in the same location. This is a result of the random population of bonus outcome symbols on the game board. In addition, at least some game symbols may represent several different prize values (for example: 100, 250, 300, or 500 credits).

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 2:
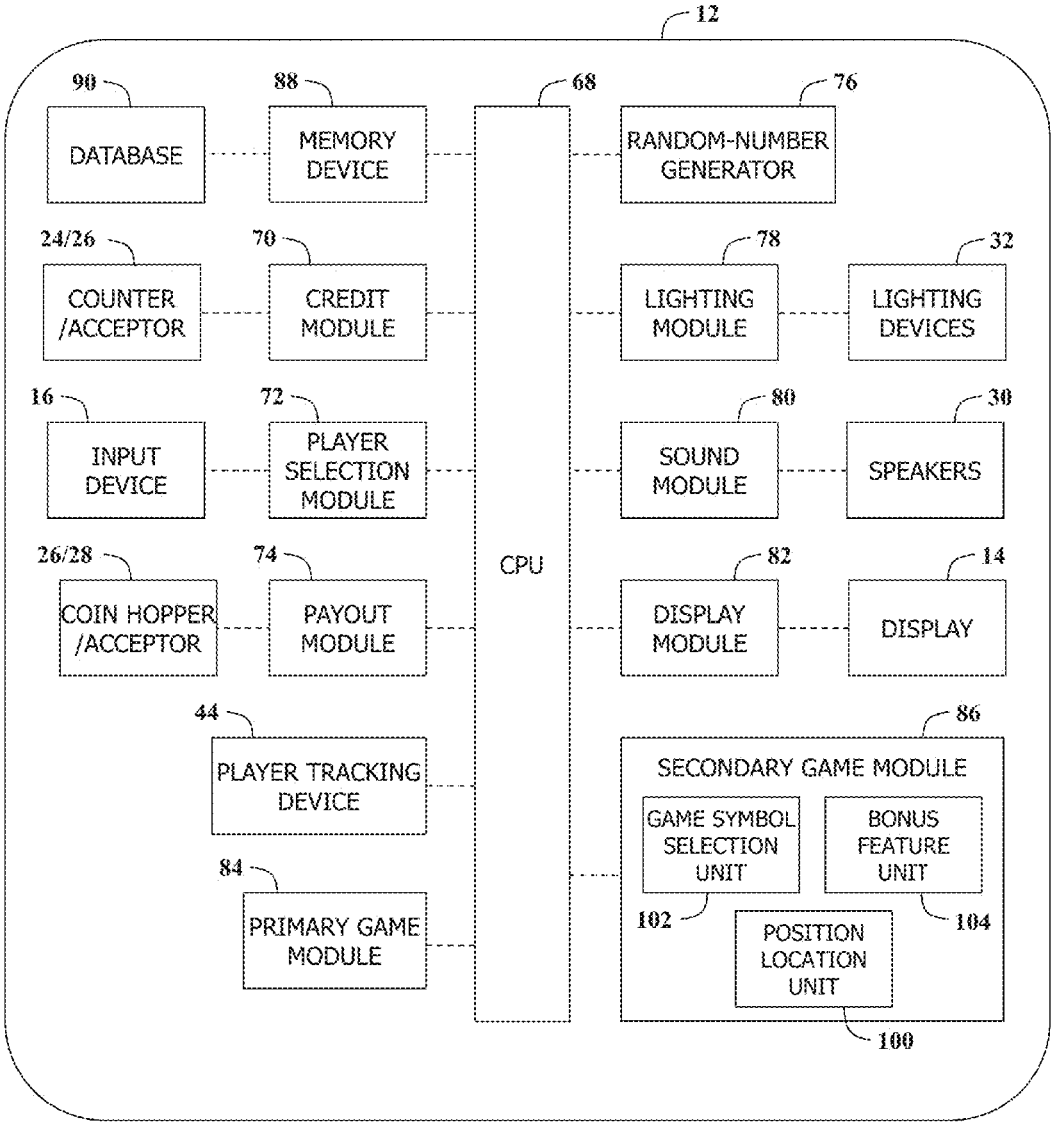
FIG. 2 is a schematic representation of a gaming controller that may be used with the gaming device shown in FIG. 1, according to an embodiment of the present invention.

FIG. 1 is a perspective view of an exemplary gaming device 10 for providing an award to a player, according to an embodiment of the present invention. FIG. 2 is a schematic representation of a gaming controller 12 that may be used with the gaming device 10. In the illustrated embodiment, the gaming device 10 includes a display device 14 for displaying a plurality of games, a user input device 16 to enable a player to interface with the gaming device 10, and a gaming controller 12 that is operatively coupled to the display device 14 and the user input device 16 to enable a player to play games being displayed on the display device 14. In one embodiment, the gaming device 10 may include a gaming machine installed in a casino. In another embodiment, the gaming device 10 may include a personal computer, laptop, cell phone, smartphone, tablet computer, personal data assistant, and/or any suitable computing device.

In the illustrated embodiment, the gaming device 10 also includes a cabinet assembly 18 that is configured to support the display device 14, the user input device 16, and/or the gaming controller 12 from a gaming stand 20 and/or a supporting surface. The display device 14 and the user input device 16 are each coupled to the cabinet assembly 18 and are each accessible by the player. In one embodiment, the gaming controller 12 is positioned within the cabinet assembly 18. Alternatively, the gaming controller 12 may be separated from the cabinet assembly 18, and connected to components of the gaming device 10 through a network such as, for example, a LAN, a WAN, dial-in-connections, cable modems, wireless modems, and/or special high-speed ISDN lines. For example, in one embodiment, the gaming controller 12 may be located remotely with respect to the gaming device 10, or within one of the gaming device cabinet assembly 18.

The user input device 16 includes a plurality of input buttons 22, a coin slot 24, and/or a bill acceptor 26. The coin slot 24 includes an opening that is configured to receive coins and/or tokens deposited by the player into the gaming device 10. The gaming controller 12 converts a value of the coins and/or tokens to a corresponding amount of gaming credits that are used by the player to wager on games played on the gaming device 10. In one embodiment, the user input device 16 may include an acceptor device which accepts media associated with a monetary value to establish a credit balance, a validator device configured to identify physical media, and a cash-out button actuatable to cause an initiation of a payout associated with the credit balance. In one embodiment, the acceptor device may be configured to receive physical media such as, for example, a coin, a medal, a ticket, a card, a bill, currency, and/or any suitable physical media that enables the gaming machine 10 to function as described herein. The acceptor device may also be configured to accept virtual media such as, for example, an RFID signal, a keypad and/or touch screen entry, a personal identification number and/or identifier, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10.

The bill acceptor 26 includes an input and output device that is configured to accept a bill, a ticket, and/or a cash card into the bill acceptor 26 to enable an amount of gaming credits associated with a monetary value of the bills, ticket, and/or cash card to be credited to the gaming device 10. Moreover, the gaming device 10 may also utilize a cashless wagering system (not shown), such as a ticket in ticket out (TITO) system (not shown). In one embodiment, the bill acceptor 26 also includes a printer (not shown) that is configured to dispense a printed voucher ticket that includes information indicative of an amount of credits and/or money paid out to the player by the gaming device 10 during a gaming session. The voucher ticket may be used at other gaming devices, or redeemed for cash, and/or other items as part of a casino cashless system (not shown). In one embodiment, the acceptor device and/or the validator device may include the coin slot 24, the bill acceptor 26, a TITO system, a cashless wagering system, and/or a player tracking device.

A coin hopper 28 is coupled to the cabinet assembly 18 and is configured to receive a plurality of coins that are dispensed from the gaming device 10. One or more speakers 30 are installed inside the cabinet assembly 18 to generate voice announcements and/or sound effects associated with game play. The gaming device 10 also includes one or more lighting devices 32 that are configured to blink and/or change brightness and color in specific patterns to produce lighting effects to enhance a visual gaming experience for the player.

In one embodiment, the input buttons 22 include a plurality of BET switches 34 for inputting a wager on a game, a plurality of selection switches 36 for selecting a betting line, a payline, and/or card, a MAXBET switch 38 for inputting a maximum wager, a PAYOUT switch 40 for ending a gaming session and dispensing accumulated gaming credits to the player, and a start switch, i.e., a SPIN/DEAL button 42 to initiate an output of a game. In the illustrated embodiment, the user input device 16 may include a plurality of physical buttons coupled to the cabinet assembly 18. In another embodiment, the user input device 16 may include a video touch display that displays video images of the input buttons 22. The user input device 16 may also include a touchless display being displayed with changeable video images of the input buttons 22.

In the illustrated embodiment, the BET switches 34 include five switches from 1BET to 5BET to enable a player to wager between a minimum bet up to 5× minimum bet. Each selection switch 36 corresponds to a betting line such as, for example, a payline and/or symbol for a reel game, one or more cards for a card game, and/or a symbol for a roulette game, to enable a player to associate a wager with one or more betting lines. The MAXBET switch 38 enables a player to input the maximum bet that a player can spend against one play of a game. The PAYOUT switch 40 enables a player to receive the amount of money and/or credits awarded to the player during a gaming session, which has been credited onto the gaming device 10.

The gaming device 10 also includes a player tracking device 44 that is coupled to the gaming controller 12 for identifying the player and/or a player tracking account that is associated with the player. The player tracking account may include, but is not limited to, gaming credits available to the player for use in playing the gaming device 10. The player tracking device 44 is configured to communicate player account information between a player tracking controller (not shown) and the gaming device 10. For example, the player tracking device 44 may be used to track bonus points and/or credits awarded to the player during a gaming session and/or track bonus and/or credits downloaded to the gaming device 10 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 44 is coupled to the gaming cabinet assembly 18 and includes a player identification card reader 46, a data display 48, and a keypad 50. The player identification card reader 46 is configured to accept a player tracking card (not shown) inserted by the player, and read information contained on the player tracking card to identify the player account information. The player identification card reader 46 may include, but is not limited to, a barcode reader, a magnetic card reader, and/or a radio frequency identification (RFID) card reader. The keypad 50 is configured to accept a user selection input such as, for example, a unique player personal identification number (PIN) to facilitate enabling the gaming device 10 to identify the player, and access player account information associated with the identified player to be displayed on the data display 48. In one embodiment, the data display 48 includes a touchscreen panel that includes the keypad 50. Alternatively, the data display 48 and the keypad 50 may be included in the display device 14.

In the illustrated embodiment, the display device 14 is configured to display a game 52 on a game screen 54 (shown in FIGS. 7-9, 11-18, and 22-23) including indicia and/or symbols for use in the game 52, e.g., cards used by a card game, roulette wheel and symbols used in a roulette game, reels used in a reel game and/or symbols and images used in a maze-type game or role-playing game. The game 52 may include any type of game including, but not limited to, a role-playing game, a puzzle game, a maze-type game, a video slot game, a keno game, a blackjack game, a video poker game, or any type of game which allows a player to make a wager, play a game, and potentially provide the player an award based on an outcome of the game and a paytable. In one embodiment, the display device 14 may include a first display 56 and a second display 58. Moreover, each display 56 and 58 may be configured to display at least a portion of the game screen 54 and/or bonus award feature screen 60. In one embodiment, the display device 14 may be configured to display a primary game 62 on the first display 56 and display a secondary game 64 on the second display 58. In addition, the display device 14 may be configured to display the secondary game 64 and a bonus feature game 66 (shown in FIGS. 11-18, and 22-23) on the first display 56 and/or the second display 58.

In one embodiment, the first display 56, and/or the second display 58 may include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 14 and as the user input device 16. In an alternative embodiment, the first display 56 and/or the second display 58 may include a plurality of mechanical reels displaying a plurality of game symbols.

Referring to FIG. 2, in one embodiment, the gaming controller 12 may include a processor, i.e., a central processing unit (CPU) 68, a credit module 70, a player selection module 72, a payout module 74, a random-number generator (RNG) 76, a lighting module 78, a sound module 80, a display module 82, a primary game module 84, a secondary game module 86, a memory device 88, and a database 90. The memory device 88 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 68 to store, retrieve, and/or execute instructions and/or data.

The CPU 68 executes various programs, and thereby controls other components of the gaming controller 12 according to player instructions and data accepted by the user input device 16. The CPU 68 in particular executes a game program, and thereby conducts a game in accordance with the embodiments described herein. The memory device 88 stores programs and databases used by the CPU 68. Moreover, the memory device 88 stores and retrieves information in the database 90 including, but not limited to, wagers, wager amounts, average wagers per game, a game type, awards, type of awards, a number of reels associated with a game, a number of symbols being displayed on each reel, secondary game symbols, position locations, secondary award records, attack bonus feature probability records, end chance probability records, enemy character selection tables, image data for producing game images and/or screens on the display device 14, and temporarily stores variables, parameters, and the like that are used by the CPU 68. In addition, the memory device 88 stores indicia, symbol weights, symbol values, paytables, and/or winning combination tables which represent relationships between combinations of random numbers and types of awards. In one embodiment, the memory device 88 utilizes RAM to temporarily store programs and data necessary for the progress of the game, and EPROM to store, in advance, programs and data for controlling basic operation of the gaming device 10, such as the booting operation thereof.

The credit module 70 manages the amount of player's credits, which is equivalent to the amount of coins and bills counted and validated by the bill acceptor 26. The player selection module 72 monitors player selections received through the input buttons 22, and accepts various instructions and data that a player enters through the input buttons 22. The payout module 74 converts a player's credits to coins, bills, or other monetary data by using the coin hopper 28 and/or for use in dispensing a credit voucher via the bill acceptor 26.

The lighting module 78 controls one or more lighting devices 32 to blink and/or change brightness and color in specific patterns in order to produce lighting effects associated with game play. The sound module 80 controls the speakers 30 to output voice announcements and sound effects during game play.

The display module 82 controls the display device 14 to display various images on a graphical interface including the game screen 54 preferably by using computer graphics and image data stored in the memory device 88. More specifically, the display module 82 controls video reels being displayed with the primary game 62 and secondary game symbols and images being displayed with the secondary game 64 and/or the bonus feature game 66 in the game screen 54 displayed on the first display 56 and/or the second display 58 by using computer graphics and the image data. In another embodiment, the display device 14 includes a plurality of mechanical reels. The display module 82 is configured to control a rotation of each of the plurality of mechanical reels to spin and stop each reel to display a game outcome.

The RNG 76 generates and outputs random numbers to the CPU 68 preferably at the start of each round of a game. The CPU 68 uses the random numbers to determine an outcome of the games. For example, if the game is a video slot game, the CPU 68 uses the RNG 76 to randomly select an arrangement of symbols to be displayed on video reels. Moreover, the CPU 68 generally uses random numbers generated by the RNG 76 to play the games and to determine whether or not to provide an award to a player. In one embodiment, the CPU 68 may also use the random numbers to determine a stop position of each reel for use in stopping each of a plurality of mechanical reels being displayed in the display device 14 to display the game outcome. The CPU 68 may also receive combinations of random numbers from the RNG 76 and compare the generated combinations with winning combinations stored in the winning combination table to determine if the generated outcome is a winning outcome that is associated with a type of award. In general, the term "award" may be a payout, in terms of credits or money. Thus, the CPU 68 may award a regular payout in response to the outcome of the game 52. However, it should be noted that the term award may also refer to other types of awards, including, prizes, e.g., meals, show tickets, etc. . . . , as well as in-game award, such as bonus features, free games, and/or free spins, or awarding the player one or more wild symbols or stacked wild symbols in each of the games.

The primary game module 84 includes a game program for use in executing the primary game 62 being displayed on the display device 14. In the illustrated embodiment, the primary game 62 is a video slot game. However, it should be noted that the primary game 62 may be any type of game upon which a player could make a wager including, but not limited to a keno game, a blackjack game, a video poker game, or any type of game that enables the gaming controller 12 to function as described herein. During play of the primary game 62, the primary game module 84 retrieves image data from the database 90 and displays the primary game 62 including a plurality of reels, each being displayed with the plurality of symbols. The primary game module 84 receives one or more wagers from the player via the user input device 16, responsively generates and outcome of the primary game 62, determines if the game outcome is a winning outcome, and provides an award to the player, if any, as a function of game outcome and the wager. Moreover, the primary game module 84 receives one or more random numbers from the RNG 76, determines an outcome of the primary game 62 as a function of the received random numbers, and spins and stops the reels to display the outcome of the primary game 62 on the display device 14.

The secondary game module 86 includes a game program for use in executing the secondary game 64 and/or the bonus feature game 66. In the illustrated embodiment, the secondary game module 86 is configured to display a secondary game 64 including a maze-type game that includes a game board 92 having a plurality of position locations 94 that are defined along a plurality of paths 96. In addition, the secondary game module 86 is configured to display a player symbol 98 (represented by a "Star" symbol in FIGS. 11 and 12) that is moved along the game board 92 between position locations 94 and along the plurality of paths 96. In one embodiment, the secondary game module 86 allows the player to move the player symbol 98 within the game board 92 in response to signals received via the user input device 16. In another embodiment, the secondary game module 86 moves the player symbol 98 within the game board 92 without input from the player. For example, in one embodiment, the secondary game module 86 may select a direction in which to move the player symbol 98 and/or select a position location 94 in which to move the player symbol 98 based on random numbers received from the RNG 76.

In the illustrated embodiment, the secondary game module 86 detects a triggering condition occurring with primary game 62 and initiates the secondary game 64 in response to detecting the triggering condition. In one embodiment, the triggering condition may be a mystery trigger condition that may occur after any bought game and/or any primary game outcome initiated based on a wager received from the player. For example, in one embodiment, the gaming controller 12 may randomly select a secondary game number from a predefined range of numbers. Upon receiving a wager for the player, the gaming controller 12 may randomly select a primary game number from the predefined range of numbers and initiate the secondary game if the primary game number matches the secondary game number. At the completion of the secondary game, the gaming controller 12 randomly selects another secondary game number from the predefined set of numbers for use in initiating subsequent secondary game. If the primary game number does not match the secondary game number, the gaming controller 12 randomly selects another primary game number when another wager associated with another primary game outcome is received from the player. In another embodiment, the gaming controller 12 may detect the triggering condition based on the appearance of one or more predefined game symbols, for example a scatter symbol, and/or a predefined combination of game symbols appearing in the primary game outcome. In addition, the triggering condition may be detected as a function of the amount of a current wager, a cumulative amount of wagers placed by the player, a level of play, player ranking, and/or any suitable triggering condition that enables the gaming controller 12 to function as described herein.

In the illustrated embodiment, the secondary game module 86 includes a position location unit 100, a game symbol selection unit 102, and a bonus feature unit 104. The position location unit 100 selects a number of position locations 94 being displayed with the secondary game 64. In one embodiment, the position location unit 100 may select a predefined number of position locations 94 being displayed with the secondary game 64. In another embodiment, the position location unit 100 may randomly select a number of position locations 94 being displayed with the secondary game 64. In addition, the position location unit 100 retrieves a previous player symbol location from the database that is indicative of the position location of the player symbol 98 at the conclusion of a previous secondary game 64 and determines the current position of the player symbol 98 based on the previous player location retrieved from the database 90.

In the illustrated embodiment, the game symbol selection unit 102 is configured to select one or more game symbols 106 from a predefined set of game symbols 106 for use with the secondary game 64 and associate each game symbol 106 with a corresponding position location 94. Each of the selected game symbols 106 is indicative of one or more actions that may be initiated by the gaming controller 12 such as, for example, providing an award to the player, initiating the bonus feature game 66, terminating and/or completing the secondary game 64, and/or any suitable action that may be initiated by the gaming controller 12.

Figure 11:
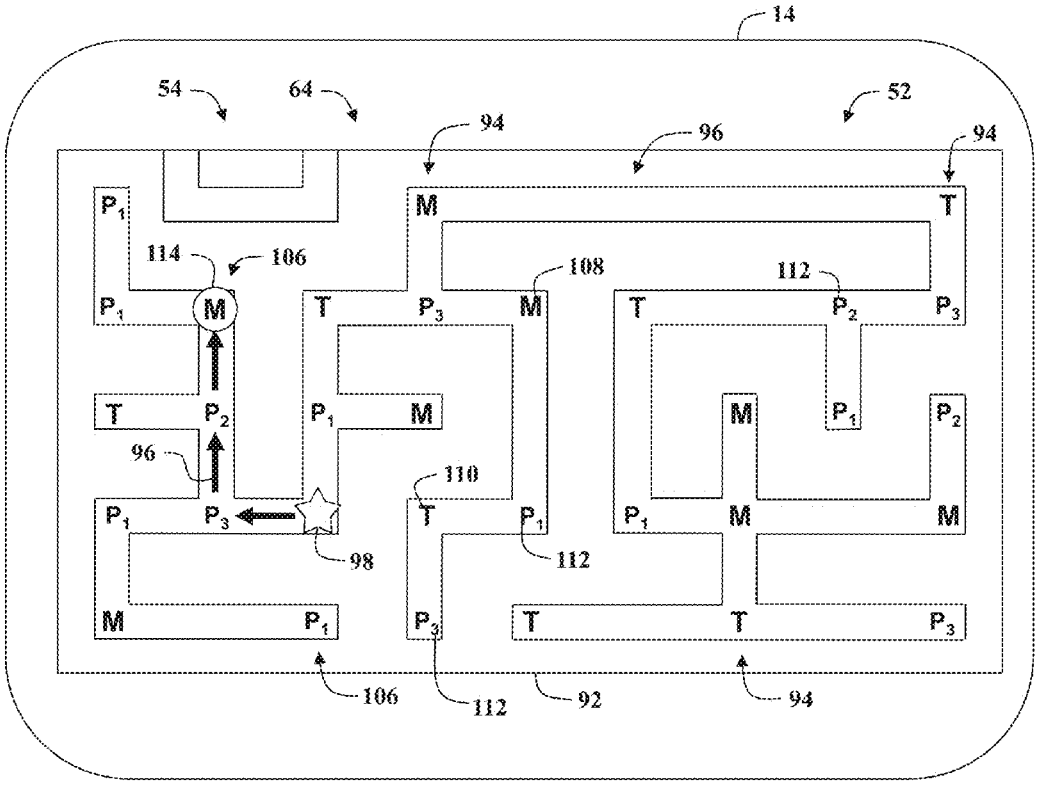
FIGS. 11-16 are exemplary entertaining graphical displays of a game screen including a secondary game that may be displayed in the gaming device shown in FIG. 1, according to an embodiment of the present invention.
Figure 12:
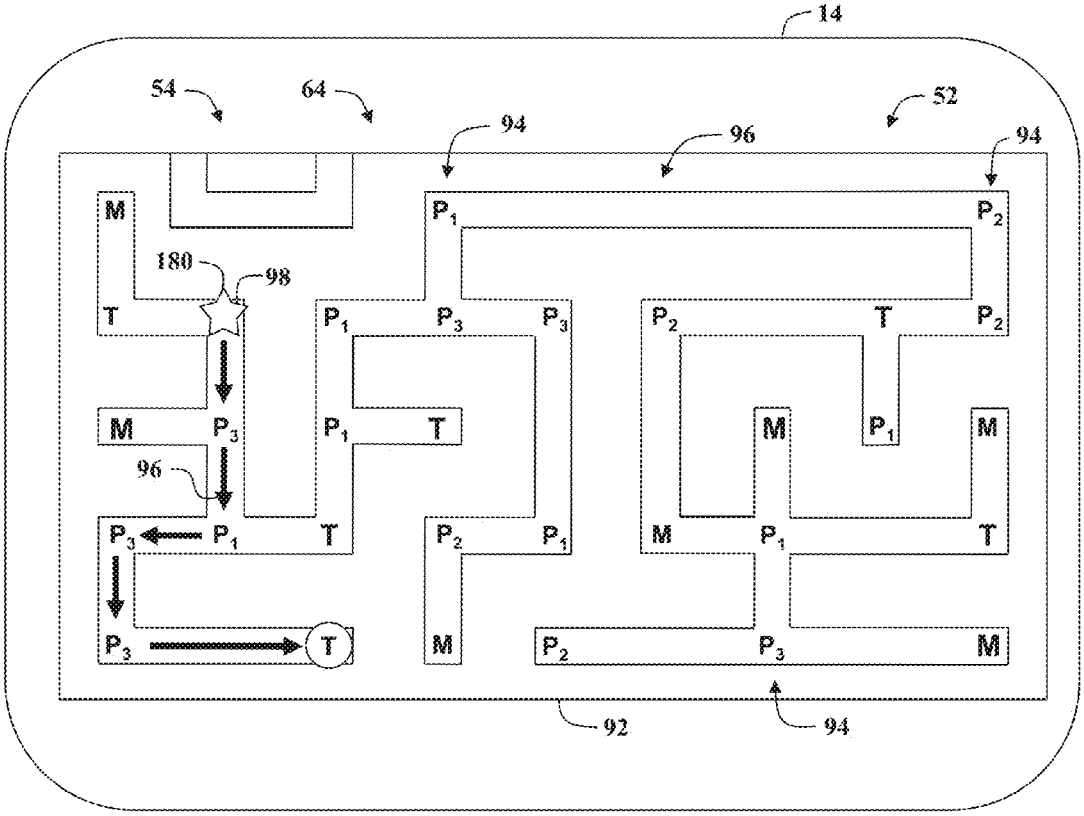
Figure 13:
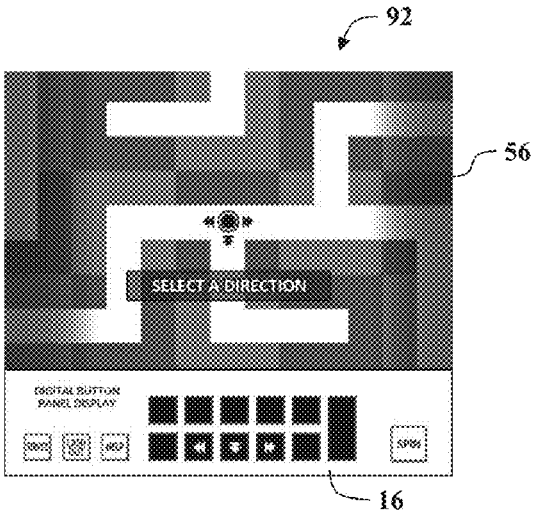
Figure 14:
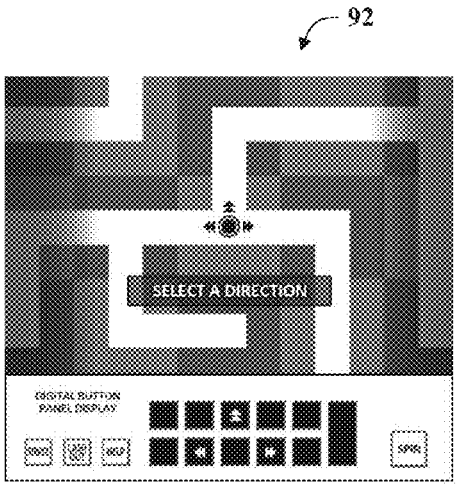
Figure 15:
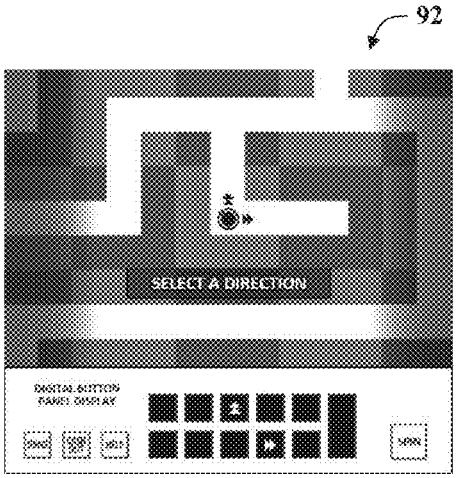
Figure 16:
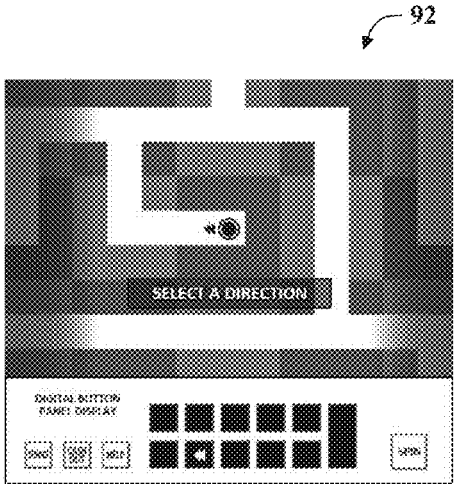
Figure 17A:
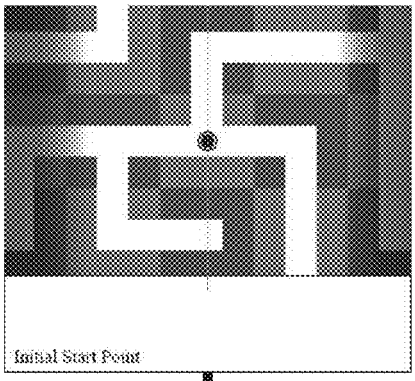
FIGS. 17*a*-17*f* are exemplary entertaining graphical displays of the secondary game shown in FIGS. 11-16, according to an embodiment of the present invention.
Figure 17B:
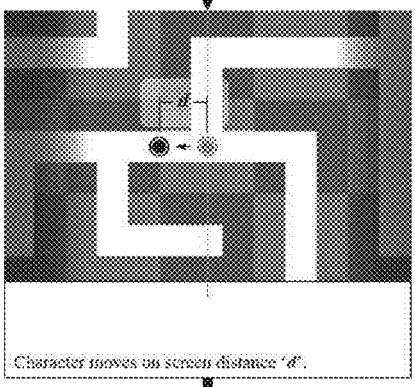
Figure 17C:
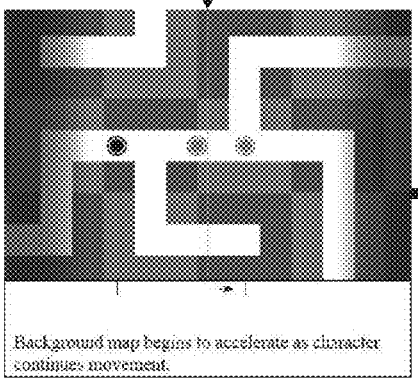
Figure 17D:
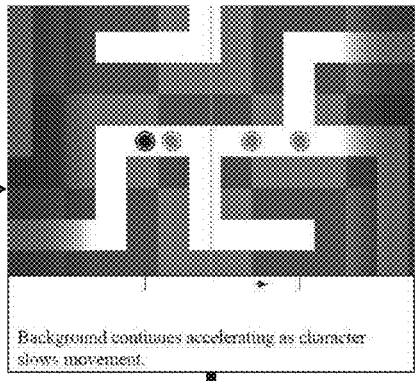
Figure 17E:
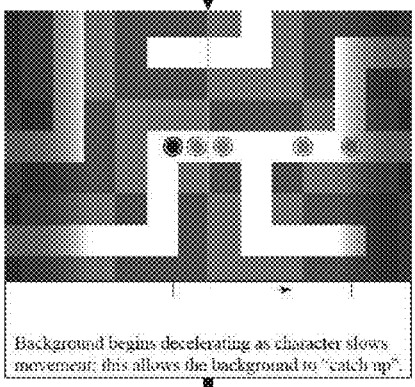
Figure 17F:
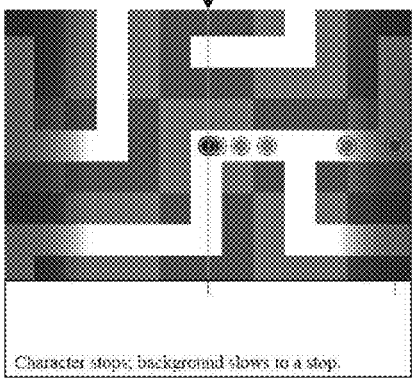

For example, in the illustrated embodiment, referring to FIGS. 11 and 12, the game symbols 106 are selected from a predefined set of game symbols that includes a bonus feature event symbol 108 (represented by the symbol "M") indicative of the bonus feature game 66, a termination symbol 110 (represented by the "T" symbol) indicative of a completion of the secondary game 64, and a prize award symbol 112 (represented by the "P" symbol) indicative of one or more prize awards. In one embodiment, the predefined set of game symbols may include a plurality of prize award symbols 112 that are indicative of a plurality of prize awards each having a different award value, such as, for example a different credit award value, number of free spins, number of addition game moves, and/or any suitable award. During play of the secondary game 64, the player symbol 98 is moved along a path 96 to a selected position location 94. The secondary game module 86 determines the game symbol 106 associated with the selected position location 94 and initiates the action associated with the corresponding game symbol 106.

In one embodiment, for each position location 94, the game symbol selection unit 102 may randomly select a game symbol 106 from the predefined set of game symbols 106 and associated the selected game symbol 106 with the corresponding position location 94. Moreover, each game symbol 106 in the predefined set of game symbols may include an associated selection probability. In one embodiment, each game symbol 106 may include a different selection probability. In another embodiment, each game symbol 106 may include a selection probability based on a number of position locations being displays with the secondary game. In addition, each game symbol 106 may have a selection probability determined as function of a wager amount and/or a number of secondary games 64 being awarded to the player.

For example, the probability of selecting a game symbol 106 associated with the number of position locations 94 may be provided as in the following chart.

| | Probability of Selecting a Game Symbol Number of Position Locations in Secondary Game | | | | |
|---|---|---|---|---|---|
| Game Symbol | n | n + 1 | n + 2 | n + 10 | n + 20 |
| Bonus Feature Game, M | 10% | 5% | 10% | 10% | 5% |
| Termination Symbol, T | 40% | 45% | 40% | 30% | 15% |
| Low Prize Award, $P_1$ | 30% | 20% | 30% | 40% | 40% |
| Med. Prize Award, $P_2$ | 15% | 20% | 10% | 15% | 30% |
| High Value Prize Award, $P_3$ | 5% | 10% | 10% | 5% | 10% |

The first column represents the game symbols 106 included in the predefined set of game symbols for use with the secondary game 64. The second column represents the probabilities of selecting each game symbol 106 associated with a number of position locations being equal to n. The third, fourth, fifth, and sixth columns represent the probability of selecting each game symbol 106 associated with a number of position locations being equal to n+1, n+2, n+10, and n+20, respectively. For example, in one embodiment, the secondary game module 86 may determine the number of position locations 94 being included in secondary game 64 and randomly select the game symbols 106 being associated with each of the position location 94 based on the selection probabilities that are determine as a function of the number of position locations 94.

The bonus feature unit 104 is configured to initiate a bonus feature game 66 in response to detecting the player symbol 98 being moved to a position location 94 being associated with a bonus feature event symbol 108. In addition, if the player symbol 98 is moved to the bonus feature event symbol 108, the secondary game module 86 completes and/or terminates the secondary game 64, stores the current player position 114 in the database for use in a subsequent secondary game 64, and initiates the bonus feature event game 66. The bonus feature unit 104 includes a game program for use in executing the bonus feature game 66 that is associated with one or more bonus awards 116. During the bonus feature game 66, the bonus feature unit 104 selects a set of bonus awards for use during the bonus feature game 66. The set of bonus awards includes an initial award value such as, for example, an initial number of game credits. The bonus feature unit 104 also enables the player to increase the award value of the set of bonus awards by obtaining winning outcomes during a role-playing game. For example, in one embodiment, the bonus feature game 66 includes a role-playing game during which the player may compete against one or more enemies to access a set of bonus awards having a higher award value. During play of the bonus feature game 66, the bonus feature unit 104 displays one or more enemy symbols 118 on a game display area 120, selects an enemy symbol number that is associated with the enemy symbol 118, and selects a player number associated with the player. The bonus feature unit 104 may determine the player number to be greater than or equal to the enemy number, determine that the player has achieved a winning result, for example the player has defeated the enemy symbol 118, and increase the award value of the set of bonus awards. In addition, upon achieving the winning result, the bonus feature unit 104 may select and display another enemy symbol 118, and select another enemy number and another player number to determine if another winning result is obtained.

If the bonus feature unit 104 determines that the selected player number is less than the selected enemy number, the bonus feature unit 104 concludes the bonus feature event, randomly selects a bonus award from the set of bonus awards having an associated current award value and provides the player with the selected bonus award. The gaming controller 12 then allows the player to continue playing the primary game 62.

Figure 3:
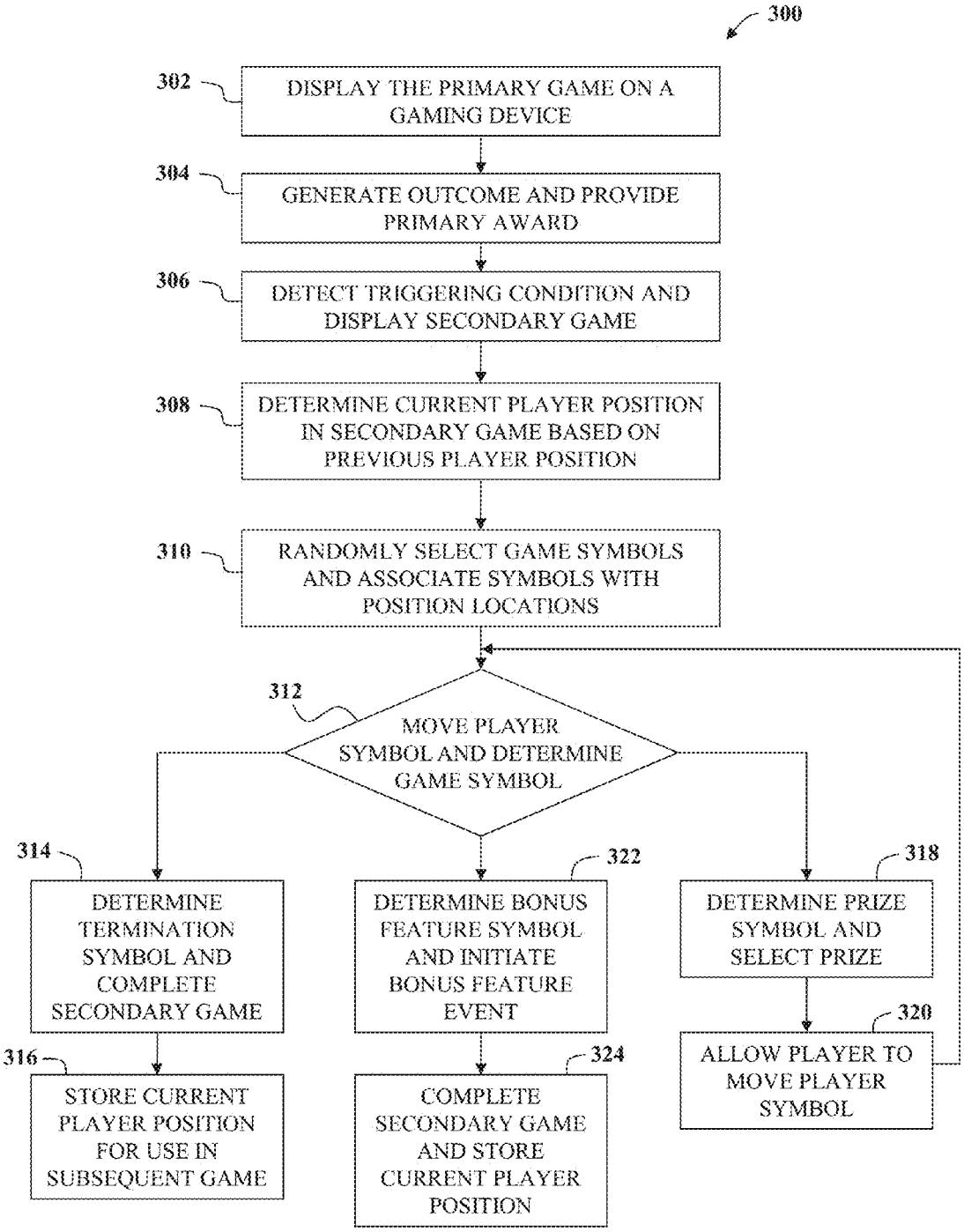
FIG. 3 is a flowchart of a method that may be used with the gaming device shown in FIG. 1 for providing a game to a player, according to an embodiment of the present invention.
Figure 4:
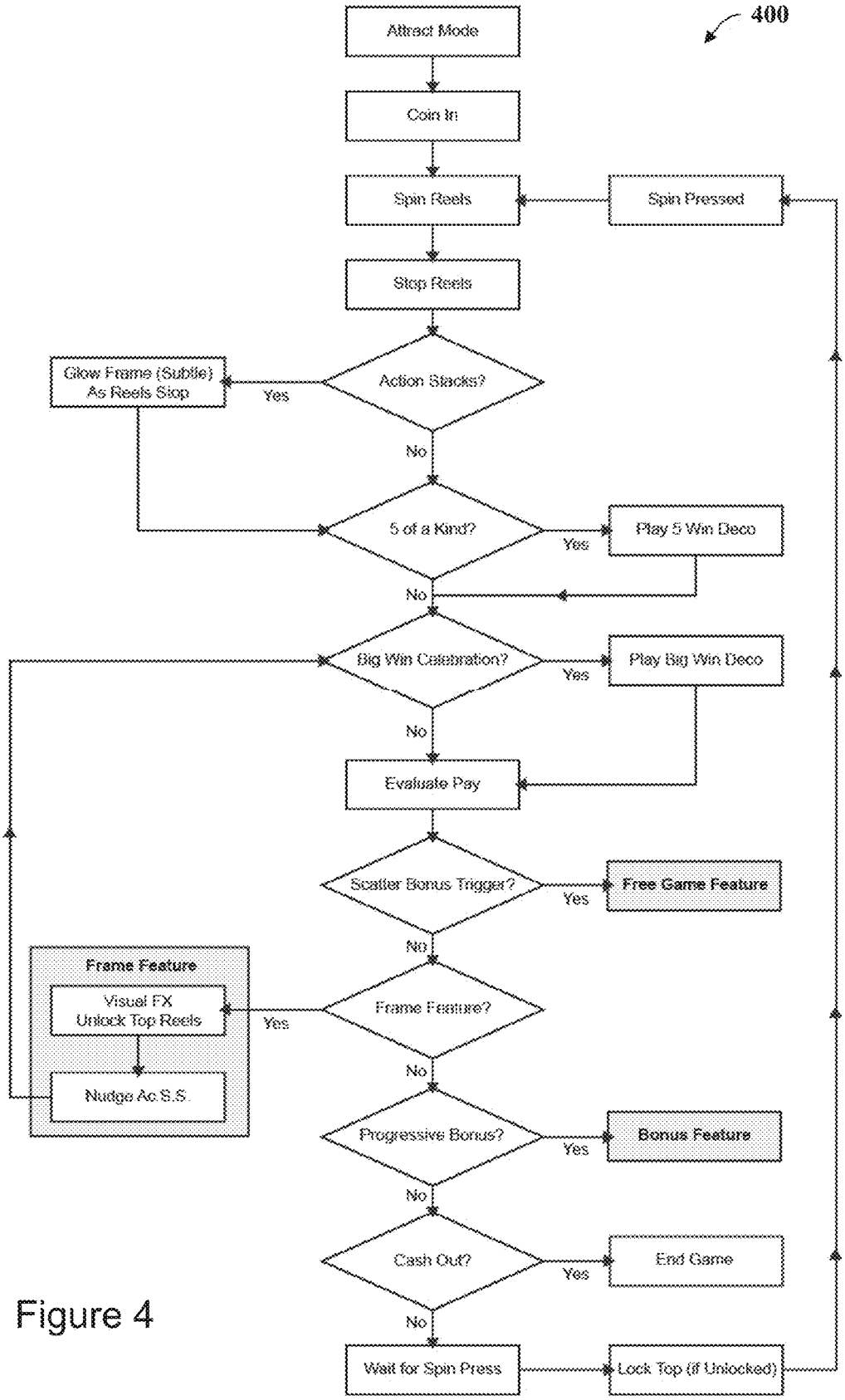
FIGS. 4-6 are flowcharts of methods that may be used with the gaming device shown in FIG. 1 for providing a game to a player, according to an embodiment of the present invention.
Figure 5:
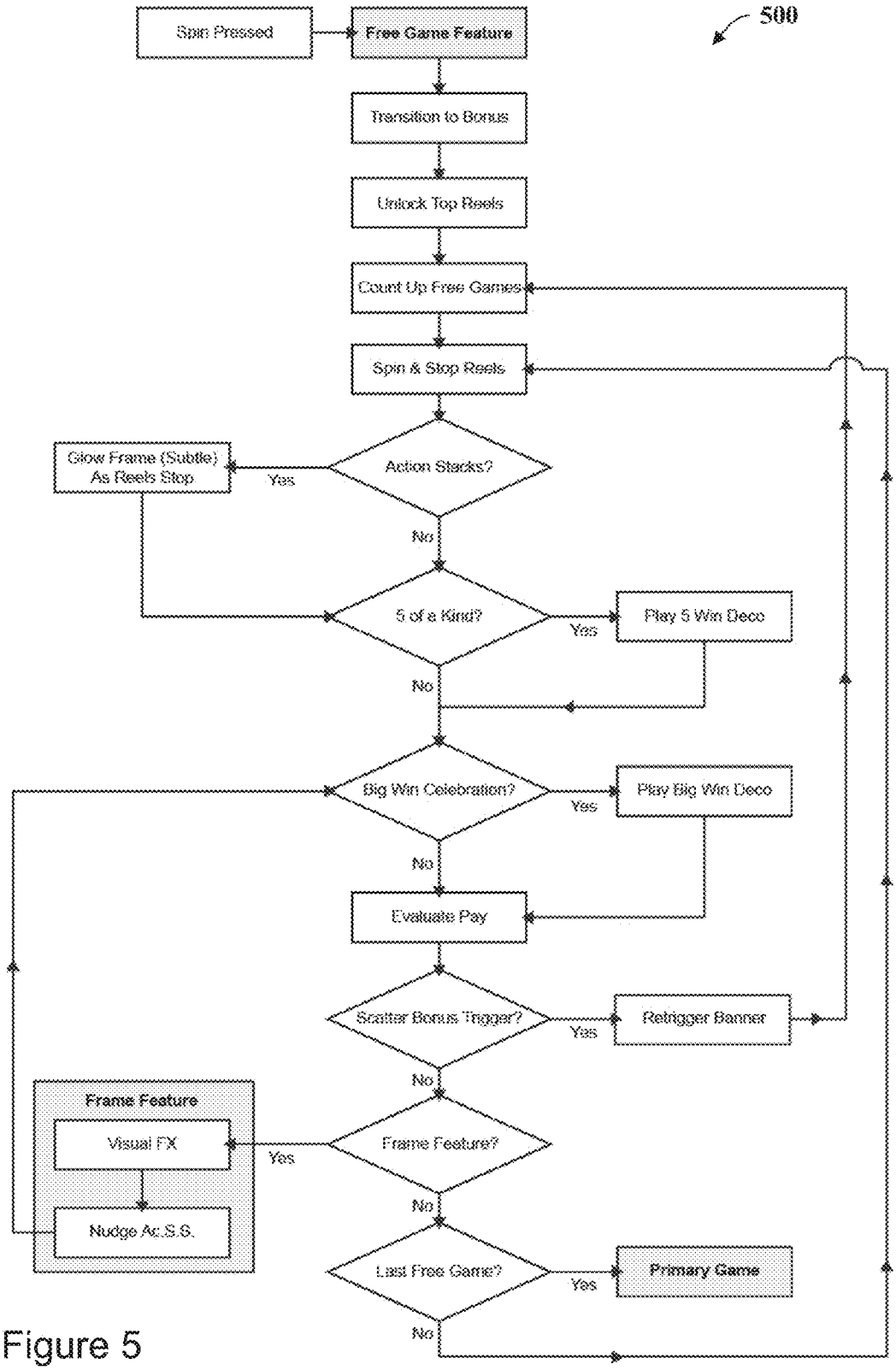
Figure 6:
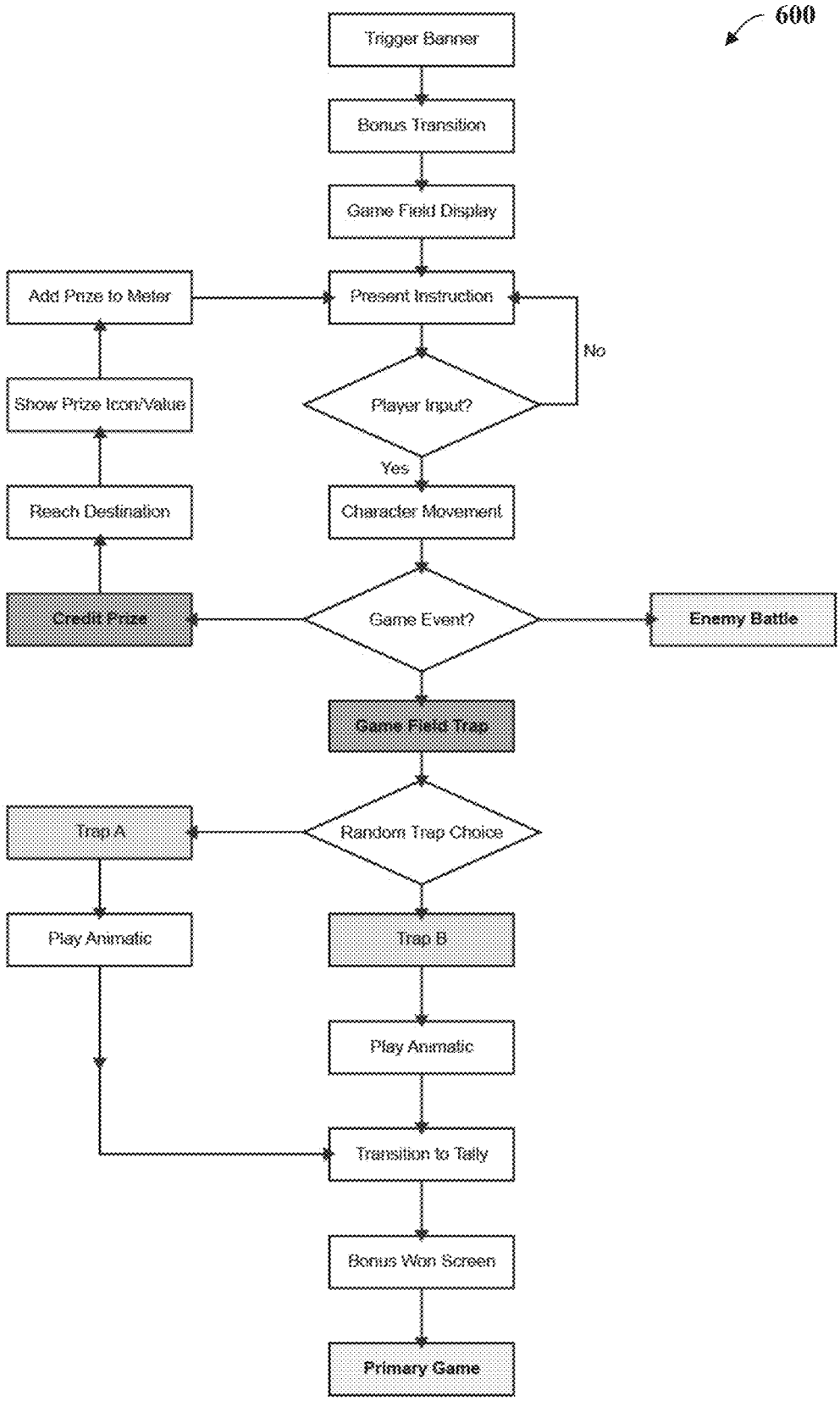
Figure 7:
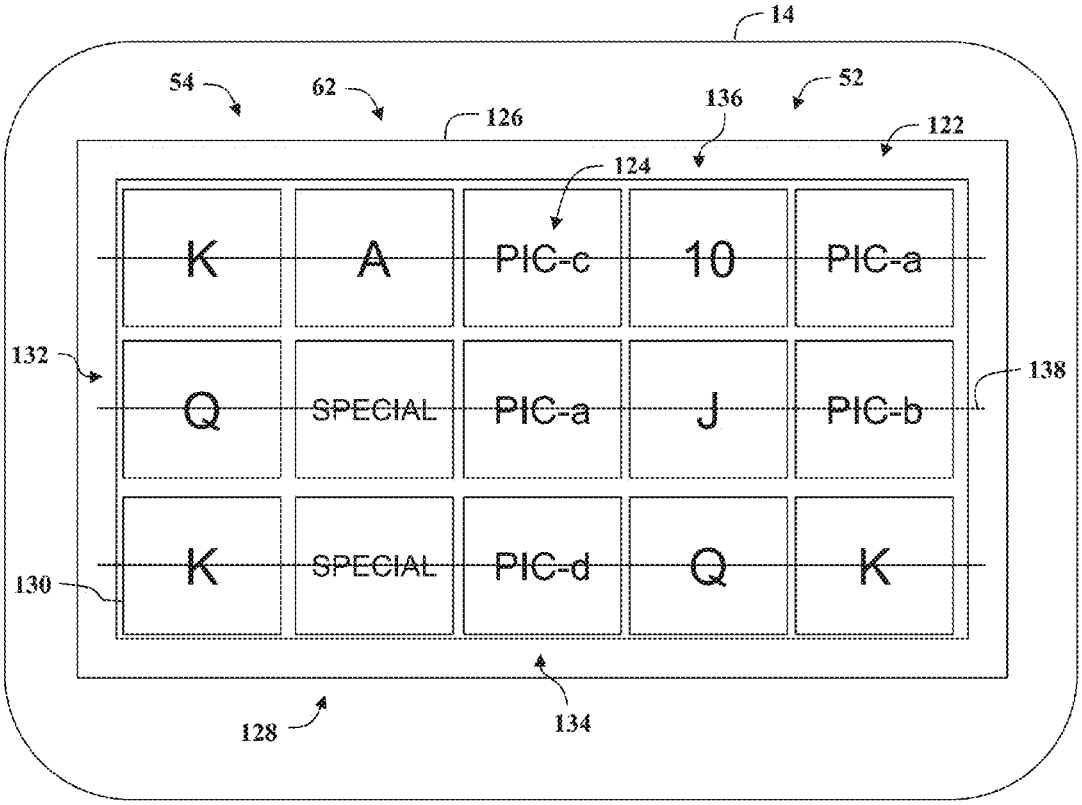
FIG. 7 is an exemplary entertaining graphical display of a game screen including a primary slot-type game that may be displayed on the gaming device shown in FIG. 1, according to an embodiment of the present invention.
Figure 8:
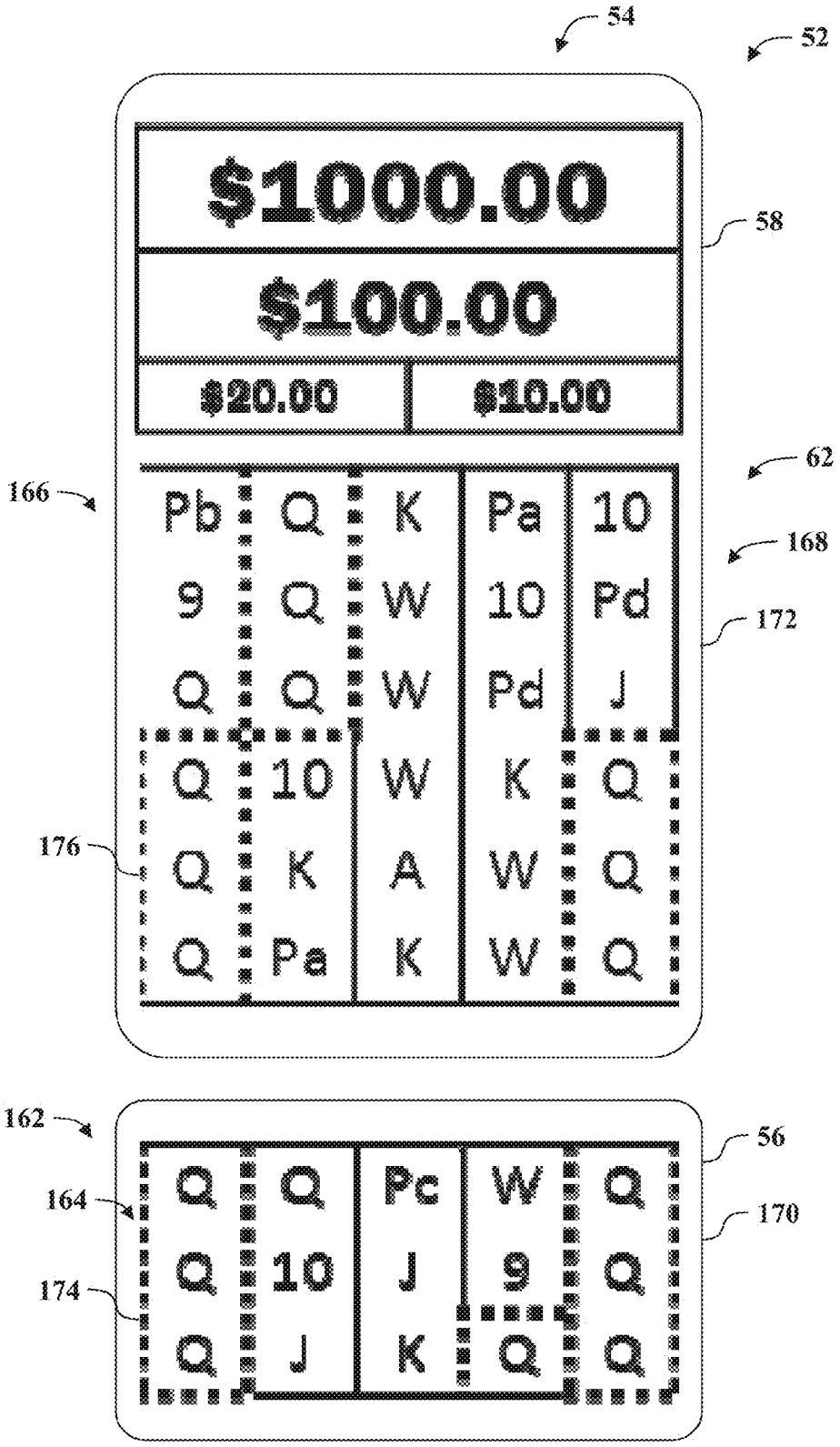
FIG. 8 is another exemplary entertaining graphical display of a game screen including a primary slot-type game that may be displayed on the gaming device shown in FIG. 1, according to an embodiment of the present invention.
Figures 9A, 9B, 9C, 9D:
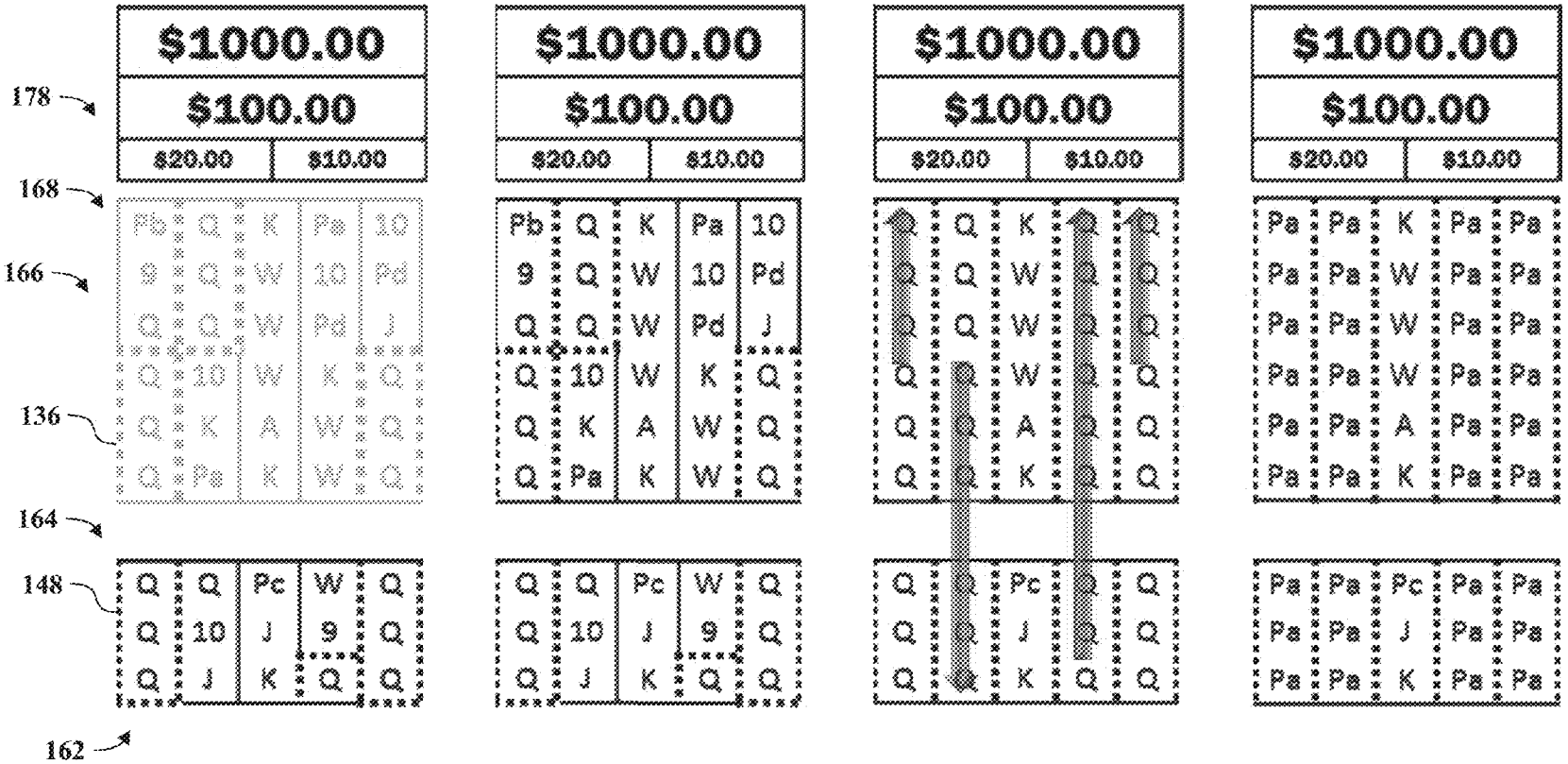
FIGS. 9*a*-9*d* are exemplary entertaining graphical displays of a free game feature that may be displayed on the gaming device shown in FIG. 1, according to an embodiment of the present invention.
Figure 10A:
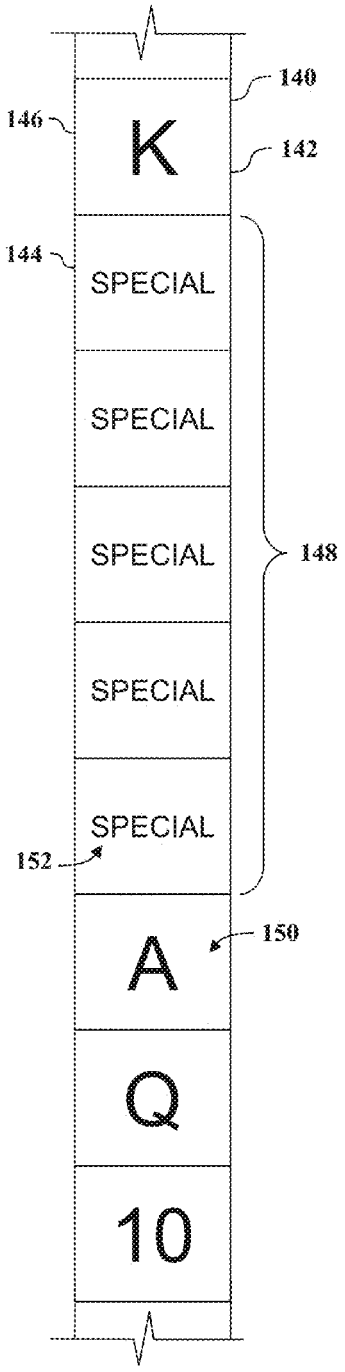
FIGS. 10*a*-10*c* are schematic representations of a reel strip that may be used with a slot reel of the primary game and free game feature shown in FIGS. 7-9*d*, according to an embodiment of the present invention.
Figure 10B:
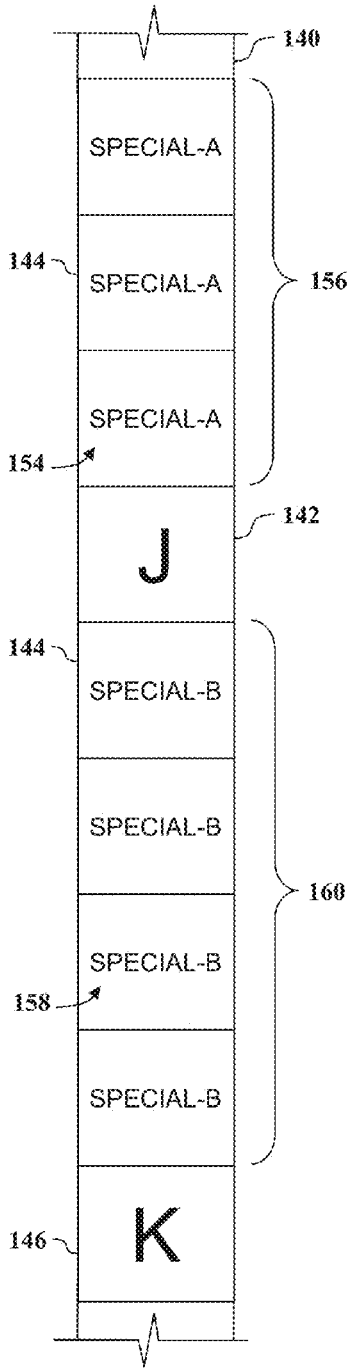
Figure 10C:
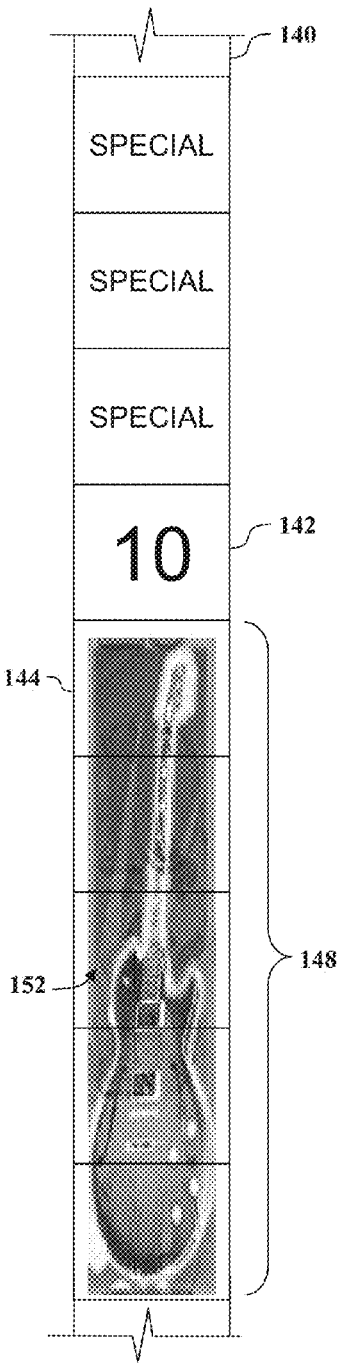
Figure 18:
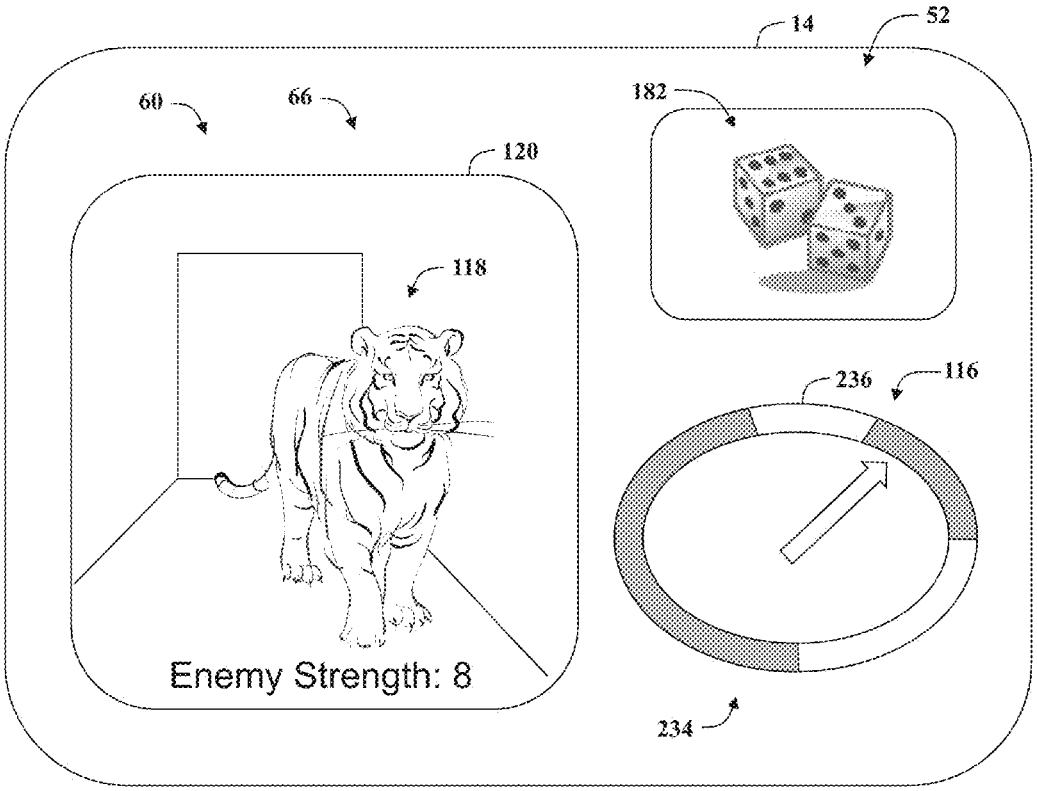
FIG. 18 is exemplary entertaining graphical display of a game screen including a bonus feature event that may be displayed in the gaming device shown in FIG. 1, according to an embodiment of the present invention.

FIG. 3 is a flowchart of a method 200 that may be used with the gaming device 10 to provide a primary game and a secondary game to a player. FIGS. 4-6 are flowcharts of additional methods 400, 500, and 600 that may be used by the gaming device 10 to provide the primary and secondary games to the player. The methods 300, 400, 500, and 600 include a plurality of steps. Each method step may be performed independently of, or in combination with, other method steps. Portions of the methods may be performed by any one of, or any combination of, the components of the one or more gaming devices 10. FIG. 7 is an exemplary entertaining graphical display of the primary game 62 that may be played with the gaming device 10. FIGS. 8 and **9*a*-9*d* are exemplary entertaining graphical displays of the primary game including a free game feature. FIGS. 10*a*-10*c* are schematic representations of a reel strip that may be used with a slot reel during the primary game and the free game feature. FIG. 11-17 are exemplary entertaining graphical displays of the secondary game 64 that may be played on the gaming device 10. FIG. 18 is exemplary entertaining graphical display of the bonus feature game 66 that may be displayed with the gaming device 10**.

In the illustrated embodiment, in method step 302, the gaming controller 12 receives a signal indicative of a wager being received by the gaming device 10 and responsively displays the primary game 62 on the display device 14. In one embodiment, the primary game 62 is a video slot game. However, it should be noted that the game 52 may be any type of game upon which a player could make a wager including, but not limited to a keno game, a blackjack game, a video poker game, or any type of game that enables the gaming controller 12 to function as described herein. In addition, in one embodiment, the game 52 may include a slot game being displayed with a plurality of mechanical reels (not shown). In the illustrated embodiment, the gaming controller 12 displays the primary game 62 on the first display 56. In another embodiment, the gaming controller 12 displays the primary game 62 on the first display 56 and/or the second display 58.

In method step 304, the gaming controller 12 randomly generates an outcome 122 of the primary game 62 and displays the generated game outcome 122 in the game screen 54. The gaming controller 12 randomly selects a plurality of primary game symbols 124 from a predefined set of possible game symbols, and displays the selected primary game symbols 124 associated with the generated game outcome 122 in the game screen 54. In the illustrated embodiment, the plurality of primary game symbols 124 are displayed in a display area 126 that includes a grid 128 having a plurality of cells 130 arranged along a plurality of rows 132 and a plurality of columns 134. Each cell 130 displays one or more primary game symbols 124 associated with the game outcome 122. In the illustrated embodiment, the gaming controller 12 displays the primary game symbols 124 within a plurality of reels 136. Each reel 136 is associated with a corresponding column 134. The game 62, in the illustrated embodiment, includes 5 reels 136 with 3 cells per reel, respectively (a "5×3" arrangement) displayed in the display area 126. Alternatively, other reel arrangements may be used such as, for example, 3-4-3-4-3, 4-5-5-5-4, or 4-5-4-5-4 arrangements or arrangements with the same number of cells per column, such as 3×3, 3×4, 4×5, or 5×5 configurations. The primary game 62 may also include a plurality of paylines 138 that extend across one or more cells 130 to indicate, to the player, a combination of primary game symbols 124.

In the illustrated embodiment, the gaming controller 12 receives a signal, from the user input device 16, that is indicative of a player's selection to initiate a gaming session including a wager amount, and a selection of one or more paylines 138 associated with a predefined set of cells 130 within the display area 126. In the illustrated embodiment, the game 62 is a multi-line game, i.e., the paylines include horizontal paylines and/or diagonal pay-lines, and/or zig-zag paylines. Moreover, the user input device 16 may allow the player to toggle to increase the bet per payline a credit at a time (up to the maximum bet). The gaming controller 12 randomly generates an outcome of the primary game 62, and displays the generated outcome 122 on the game screen 54. In one embodiment, the gaming controller 12 is configured to rotate, and/or spin each reel 136 to initiate a game play, and stop each reel 136 to display a plurality of primary game symbols 124 associated with the randomly generated outcome 122. In addition, the gaming controller 12 is adapted to determine if the generated outcome 122 is a winning outcome as a function of the displayed primary game symbols 124, a paytable, a wager, and one or more player selected paylines 138. More specifically, the gaming controller 12 determines if a combination of symbols 124 arranged along the selected payline 138 is a winning combination. The gaming controller 12 may provide an award in response to the outcome of the game 62.

Each primary game 62 is generally played in a conventional manner. The player makes a wager, which may be based on a predetermined denomination and a selected number of paylines 138, the gaming controller 12 randomly generates an outcome for the game 62, spins the reels 136, and selectively stops the reels 136 to display a primary game symbol 124 in each of the display cells 130. If a predetermined pattern of primary game symbols 124 is randomly chosen for each cell 130 on a played payline 138, the player may be awarded a payout based on the payline, the wager, and a predetermined paytable. Moreover, the player may be awarded a payout if the combination of primary game symbols 124 associated with a selected payline 138 is a winning combination. In addition, a player may receive a bonus feature, bonus games, and/or free games based on the combination of primary game symbols 124 associated with the selected payline 138 and/or the appearance of one or more special game symbols in the game outcome 122. Many variations to the above described general play of a slot game fall within the scope of the present invention. Such slot games are well-known in the art, and are therefore not further discussed.

In one embodiment, referring to FIG. 10*a*-10*c*, the gaming controller 12 may display one or more of the reels with a reel strip 140 that includes a plurality of symbol positions 142 that each have a game symbol 124 displayed therein. During display of the primary game, the gaming controller 12 spins each reel 136 such that the game symbols 124 are moved through each of the cells 130 in the display area 126. In the illustrated embodiment, one or more reel strips 140 includes a plurality of special symbol positions 144, a plurality of normal symbol position 146, and at least one set of action stacked symbols that includes a run 148 of consecutive symbol positions 144 including a plurality of adjacent special symbol positions 144. Each normal symbol position 146 includes a static normal symbol 150. During each play of the game, the gaming controller randomly selects at least one special symbol 152 from the predefined set of special symbols 152, and displays the selected special symbol 152 in each special symbol position 144 included in the action stacked symbols 148. Additional details of action stacked symbols includes runs of consecutive symbol positions, which may be used in the present invention, are described in U.S. patent application Ser. No. 11/299,009 to Yoshimi, now U.S. Pat. No. 8,096,869, filed Dec. 9, 2005, titled "Gaming Machine with Runs of Consecutive Identical Symbols", which is incorporated herein by reference in its entirety.

Referring to FIG. 10*b*, in one embodiment, the reel strip 140 may include a plurality of runs 148 of consecutive special symbol positions 144. For example, in one embodiment, the reel strip 140 may include at least two runs 148 of consecutive special symbol positions 144. During game play, the gaming controller 12 randomly selects a special symbol 152 and displays the selected special symbol 152 in each special symbol position 144 of the runs 148 of consecutive special symbol positions 144. Moreover, the reel strip 140 may include at least one normal symbol position 146 displayed between the runs 148 of consecutive special symbol positions 144.

In one embodiment, the gaming controller 12 may randomly select a different special symbol 152 to be displayed in each of the runs 148 of consecutive special symbol positions 144 and display a corresponding selected special symbol 152 in each special symbol position 144 of the associated run 148 of consecutive special symbol positions 144. For example, in one embodiment, the gaming controller 12 may select a first special symbol 154 (e.g. "Special-A") to be displayed in a first run 156 of consecutive special symbol positions 144, and select a second special symbol 158 (e.g. "Special-B") to be displayed in a second run 160 of consecutive special symbol positions 144. In one embodiment, the first special symbol 154 and the second special symbol 158 are different. In another embodiment, the first special symbol 154 and the second special symbol 158 are similar. Moreover, the first and second special symbols 154 and 158 may be the same special symbol. In addition, the first and second special symbols 154 and 158 may be selected from the same category of special symbols and/or be selected from different categories of special symbols.

Referring to FIG. 10*c*, in one embodiment, the gaming controller 12 may display a special symbol 152 having a plurality of symbol images such that a plurality of adjacent special symbols 152 are displayed as a unitary image that extends across a run 148 of consecutive special symbol positions 144. For example, the gaming controller 12 may randomly select a special symbol 152 to be displayed in each special symbol position 144 of a run 148 of consecutive special symbol positions 144, wherein the selected special symbol 152 includes a plurality of symbol images. Each selected special symbol 152 is displayed in each of the adjacent special symbol positions 144 with a different symbol image such that a unitary symbol image extends across each adjacent special symbol position 144.

In another embodiment, the gaming controller 12 may select a plurality of special symbols 152 from the same category of special symbols, wherein each selected special symbol 152 forms a portion of the unitary symbol image such that when the selected special symbols 152 are displayed in each adjacent special symbol position 144 of a run 148 of consecutive special symbol positions 144, the unitary symbol image is displayed across the adjacent special symbol positions 144.

In one embodiment, referring to FIG. 8-9, the gaming controller 12 may display the primary game 62 including a main game 162 being displayed with a first reel set 164 and a bonus free game 166 that is displayed with a second reel set 168. In one embodiment, the first reel set 164 is displayed on the first display device 56 and the second reel set 168 is displayed on the second display device 58. Alternatively, the first reel set 164 and the second reel set 168 may be displayed on the same display device. In one embodiment, each reel set may be displayed with separate reels 136. Alternatively, the first reel set 164 and the second reel set 168 may be displayed using the same reels 136. For example, as shown in FIG. 8, the gaming controller 12 may display the primary game 62 in a first display area 170 and the bonus free game 166 in a second display area 172 that is different than the first display area 170. The gaming controller 12 may also display the primary game 62 and the bonus free game 166 with at least one reel 136 that extends from the bonus free game 166 to the primary game 62 such that a portion of the reel 136 is displayed in the first display area 170 and the second display area 172 simultaneously.

For example, in the illustrated embodiment, the gaming controller 12 displays the primary game 62 with a first portion 174 of the reel 136 being displayed in the first display area 170, and displays the bonus free game 166 with a second portion 176 of the reel 136 being displayed in the second display area 172. In one embodiment, the gaming controller 12 displays the primary game 62 concurrently with the bonus free game 166 such that the first and second portions 174 and 176 of the reel 136 are visible to the player simultaneously. In the illustrated embodiment, the gaming controller 12 randomly generates an outcome of the primary game 62 and spins and stops the reel 136 to display the primary game outcome. The gaming controller 12 also spins the reel 136 such that a symbol 124 being displayed on the reel strip 140 that is associated with the reel 136 is moved from the second display area 172 to the first display area 170. Additional details of displaying multiple games with the same reel, which may be used in the present invention, are described in U.S. patent application Ser. No. 14/316,131 to Satoshi Suda, now U.S. Pat. No. 9,047,741, filed Jun. 26, 2014, titled "Gaming Machine and Methods of Allowing a Player to Play a Gaming Machine Having Multiples Games with the Same Reel", which is incorporated herein by reference in its entirety.

In one embodiment, during play of the primary game 62, the gaming controller 12 may implement method 400 and method 500. For example, the gaming controller 12 may display game symbols 124 including SCATTER, WILD, PIC-A, PIC-B, PIC-C, PIC-D, A, K, Q, J, 10 and 9. The WILD symbol substitutes for all symbols except for SCATTER. WILD symbols are stacked 3 high on all reels in addition to occurring as a single symbol on all reels. All the symbols have the possibility to appear on every reel. Wins are on selected lines only from left most reel to the right on adjacent reels. Each reel 136 may also contain a number of action stacked symbols 148 including adjacent positions that are randomly replaced with one of the following symbols: PIC-A, PIC-B, PIC-C, PIC-D, A, K, Q, J, 10 and 9. The gaming controller 12 may also display the action stacked symbols 148 with a frame that surrounds each symbol in the stack.

The gaming controller 12 may detect a triggering condition occurring in the primary game 62 and initiate a frame feature 178 that includes the bonus free game 166. For example, referring to FIGS. 9*a*-9*d*, in one embodiment, during play of the primary game, the second reel set 168 is locked except when the frame feature 178 is triggered. During the primary game 62, each reel contains a number of action stacked symbol positions including a number of adjacent positions being displayed with a frame and that are replaced with symbol that is selected from a predefined set of symbols before the reel spin. All replacement action stacked symbol positions in a corresponding reel are filled with the same symbol.

During play of the primary game 62 a frame of action stacked symbols appearing on 3 or more of the reels triggers the frame feature 178. When the frame feature 178 occurs, the second reel set 168 becomes active. In addition, then the second reel set 168 become active, any reels with the action stacked frame appearing in the first reel set 164 are nudged until all positions on the first reel set 164 and the second reel set 168 display the action stacked frame. All symbols within the action stacked frame are randomly replaced with symbols selected from a predefined set of symbols. All positions included in a corresponding action stacked frame are filled with the same symbol. The initial symbol shown in each frame may be selected for replacement.

The gaming controller 12 may detect at least 3 reels in the main game 162 (located on the bottom screen) displaying one or more action stacked symbols 148 appearing in the outcome. The gaming controller determines any winning paylines in the main game 162, provides the player with any wins created, then activates the second reel set 168 of the bonus free game 166 (shown in FIG. 9*b*). As the bonus free game 166 becomes active, the action stacked symbols 148 are then expanded to both games and a different action stacked symbol is selected and displayed in each symbol positioned included in the corresponding expanded run of consecutive symbol positions (shown in FIGS. 9*a*-9*d*), and any resulting wins created are paid to the player. A different symbol may be selected for each of the expanded set of action stacked symbols (WILD now also being an option).

In another embodiment, the gaming controller 12 may initiate a free game feature including a number of free games including the main game 162 and the bonus free game 166. For example, upon detecting 3, 4 and 5 Scatter symbols appearing in the outcome of the first reel set 164 of the main game 162, the gaming controller 12 may award 5, 10 or 20 free games respectively. The gaming controller 12 then activates the first reel set 164 and the second reel set 168 during the free games. Additional free games may be triggered during the free games. 3, 4 and 5 scatter symbols during the free games award an additional 3, 4 and 5 free games respectively. During the free games, an action stacked frame appearing on 3 or more reels triggers the frame feature. Any reels with the action stacked frame appearing on the reel are nudged until all symbol positions on both the first reel set 164 and the second reel set 168 display corresponding action stacked frames. All symbols within the action stacked frame are randomly replaced with symbols selected from a predefined set of symbols. All positions included in a corresponding action stacked frame are filled with the same symbol. The initial symbol shown in each frame may be selected for replacement.

In method step 306, the gaming controller 12 detects the occurrence of a triggering condition during the primary game 62 and initiates the secondary game 64 (shown in FIGS. 11-17) in response to detecting the triggering condition. In one embodiment, the gaming controller 12 may implement method 600. In the illustrated embodiment, the triggering condition is mystery trigger condition that may be detected after any primary game outcome. The gaming controller 12 may randomly select a secondary game number from a predefined range of numbers and, upon receiving a wager from the player, the gaming controller 12 randomly selects a primary game number detects the triggering condition if the primary game number matches the secondary game number. In one embodiment, the triggering condition may be defined as a winning combination being formed along a selected payline. In another embodiment, the triggering condition may include an appearance of one or more special symbols being displayed in the outcome of the primary game 62. In another embodiment, the gaming controller 12 may define the triggering condition as a predefined amount of wagering credits being placed as a wager during the primary game 62 and/or a predefined number of primary games being played by the player.

In the illustrated embodiment, the gaming controller 12 displays the secondary game 64 including a game board 92 being displayed in the game screen 54 and a plurality of paths 96 being displayed on the game board 92 including a plurality of position locations 94. In one embodiment, the gaming controller 12 displays the secondary game including a predefined number of position locations 94. In another embodiment, the gaming controller 12 randomly selects a number of position locations 94 and displays the selected number of position locations 94 on the game board 92.

In method step 308, the gaming controller 12 determines a current player position 114 within the game board 92 and responsively displays a player symbol 98 at the current player position 114. The current player position 114 is associated with one of the plurality of position locations 94 and is indicative of a previous position location 180 of the player symbol (represented by a "Circle" symbol in FIG. 11) at a completion of a previous secondary game 64. In the illustrated embodiment, the gaming controller 12 retrieves the previous player symbol location from the database 90 and determines the current player position 114 based on the previous player position. More specifically, the gaming controller 12 determines the position location 94 associated with the player symbol 98 at the completion of the previous secondary game 64 and displays the player symbol 98 at the previous position location 180.

In method step 310, the gaming controller 12 randomly selects a plurality of secondary game symbols 106 from a predefined set of game symbols and associates the selected secondary game symbols 106 with each of the plurality of position locations 94. In the illustrated embodiment, the predefined set of game symbols includes the bonus feature event symbol 108 (represented by the symbol "M") indicative of the bonus feature game 66, the termination symbol 110 (represented by the "T" symbol) indicative of a completion of the secondary game 64, and one or more prize award symbols 112 (represented by the "$P_n$" symbol) indicative of one or more prize awards. In the illustrated embodiment, the gaming controller 12 randomly selects a secondary game symbol 106 for each of the number of position locations 94 being displayed in the game board 92. In another embodiment, the gaming controller 12 may randomly select a number of each of the secondary game symbols 108, 110, and 112, and randomly assign each selected secondary game symbol 106 to one of the position locations 94. For example, in one embodiment, the gaming controller 12 randomly selects each of a first number of bonus feature event symbols 108, a second number of termination symbols 110, and a third number of prize award symbols 112 for use with the secondary game 64. In the illustrated embodiment, the secondary game symbols 106 are not initially displayed on the game board 92 such that the location of the secondary game symbols 106 are not visible to the player.

In method step 312, the gaming controller 12 allows the player to select a position location 94 and responsively moves the player symbol 98 from the current player position to the selected position location 94 in response to player input received from the user input device 16. In the illustrated embodiment, the player is allowed to move the player symbol 98 to an adjacent position location 94 located along one or more adjacent paths 96. In another embodiment, the player is allows to move the player symbol 98 to any position location 94 within the game board. In one embodiment, the gaming controller 12 may randomly select a position location 94 and move the player symbol 98 to the randomly selected position location 94 on behalf of the player. In the illustrated embodiment, the gaming controller 12 determines the game symbol 106 that is associated with the selected position location 94 and provide a secondary award, if any, to the player as a function of the associated secondary game symbol 106. In addition, the gaming controller 12 displays the secondary game symbol 106 associated with the selected position location upon moving the player symbol 98 to the selected position location 94 such that the associated secondary game symbol 106 is visible to the player.

In method step 314, the gaming controller 12 determines if the secondary game symbol 106 associated with the selected position location 94 is a termination symbol 110 and responsively concludes the current secondary game 64 and returns game play to the primary game 62.

In method step 316, upon determining that the player has selected the termination symbol 110, the gaming controller 12 identifies the current position location of the player symbol 98 and stores the current player position 114 in the database 90 for use in a subsequent secondary game 64.

In method step 318, the gaming controller 12 determines if the secondary game symbol 106 associated with the selected position location 94 is a prize symbol 112 and responsively provides the player a prize award associated with the prize symbol 112. In one embodiment, the secondary game 64 may include a plurality of prize symbols 112 associated with the position locations including a first prize symbol having a first prize award value and a second prize symbol having a second prize award value that is different than the first prize award value. Upon selecting a prize symbol 112 the gaming controller 12 may determine the prize award value associated with the prize symbol 112 and provide the player with the determined prize award. In another embodiment, the prize symbol 112 may be associated with a plurality of awards and the gaming controller 12 may randomly select an award from the associated plurality of awards and provide the player with the selected award.

In method step 320, upon determining that the player has selected a prize symbol 112, the gaming controller 12 allows the player to select another position location 94 and returns to method step 312 and moves the player symbol 98 to the selected position location 94.

In one embodiment, referring to FIGS. 13-17, when the player is in the game board 92 portion of the game, two input methods of navigating the on screen character are available to the player. One option is to select one of the directional arrows are available to the player during a waiting input phase of the game. The directional arrows are displayed on the game screen in the vicinity of the player's character. Selecting one of the available arrows initiates character travel in the selected direction.

A second method of player input is by use of the digital button panel on the user input device 16 of the gaming machine itself. The digital button panel has the advantage of using nearly (or identically) the same graphic representation of the on screen directional input (arrow) graphics. In the graphical examples shown, the player's character (represented by the circle on the graphic) is surrounded by double arrows. These same graphical arrows are shown in the digital button panel display on the machine, juxtaposed in such a way to mimic the four main cardinal points on a compass (N, S, E, and W). It should be noted that the arrows on the digital button panel do not necessarily need to be juxtaposed this way. They could be set up linearly across the top row of buttons, the bottom row of buttons, two directions on each row, etc.

Another main point is the directional arrows that are utilized in the gaming application are dynamic in nature. The basis of the game is that the character moves in the selected direction of the game field until a corner, intersection, battle, or trap is reached. When a corner or intersection is reached, the opportunity for the player to select another direction of travel is given. The directions available to the player, though, may or may not be the same as previous. It is dependent entirely on the design of the game field. As shown in FIGS. 13-16, the available directions of travel may change based on the character's location on the game field. In one case, three directions are available to the player, in another, two directions, and yet in another, only one direction is available. These are dynamically shown on both the game screen and the digital button panel display.

Referring to FIGS. 13-16, in one embodiment, when the player is in the game field portion of the bonus game, there are three elements that are in play to provide to the player that they are navigating a character through the game field: the player's character, the game field itself, and a top-down view camera. The game field is a three dimensional object that occupies both the top and bottom screens of the game. It should be noted that when the camera moves during the bonus game, the game field on the top and bottom screens move in unison. The game field itself does not move, however, the game field is replicated (or added on to) when the player's character nears the edge of the existing displayed game field. This in turn gives the impression that the game field is "never ending". The player's character is a 2 dimensional image/animation placed on a 3 dimensional plane. When the bonus game starts, the player's character is located at roughly the center of the bottom screen window. This serves as a "home base" for the character and all movements, no matter which direction, stem from this center point. Finally, the camera is located in three-space—looking down at the character that rests atop the game field. For purposes of describing the functionality contained herein, the character and the camera are the principal elements that are described.

FIGS. 17*a*-17*f* illustrate a series of events that transpire after the player selects a direction for the character to move. The player's character starts at the center of the bottom screen window. When the player initiates an available direction for the character to move, the software initiates the walking animation on the plane while at the same time begins to accelerate the character in the chosen direction. When the plane reaches a certain distance from the starting point (represented in the images at right by "d"), software then begins accelerating the camera in the opposite direction that the player's character is moving. It should be noted that the distance, d, does not have to be a consistent value. To add variety, the distance may be greater or shorter to provide anticipation to the player. In addition, the acceleration amount of the character or the camera does not have to be constant as well. For example, if the player's character is running, acceleration of the player's character on the screen will be faster than if the player's character was walking. Since the game field includes a "fog of war" that overlays it, camera acceleration may be delayed to first show the character heading into the "darkness" on the edge of the visible window and then accelerating rapidly to reveal the game field and any event that may occur during the character's travels on the game field.

As the character reaches their destination on the game field, software slows the character down. The camera, still moving in the opposite direction, plays "catch up" to re-center the player's character in the viewable game window. As the character (by way of camera movement) approaches the center of the game window, it slows down as well, coming to a stop when the character is centered in the game window. The images shown on this page and the next page should help to illustrate visually the methodology of character movement on a game field.

In method step 322, the gaming controller 12 determines if the secondary game symbol 106 associated with the selected position location 94 is a bonus feature event symbol 108 and responsively initiates the bonus feature game 66. During a round of the bonus feature game 66, the gaming controller 12 displays an enemy symbol 118. The gaming controller 12 randomly selects a first enemy symbol number from a predefined range of numbers, and randomly select a first player number from the predefined range of numbers. In one embodiment, the gaming controller 12 may select a predefined enemy symbol number that is indicative of a relative strength and/or number of previous enemy symbols 118 that have been displayed. In another embodiment, the gaming controller 12 may randomly select the enemy symbol number. In addition, the gaming controller 12 may display one or more dice 182 that are rotated and stopped to simulate rolling dice for use in displaying the selected player number during each round of the bonus feature game 66.

The bonus feature game 66 allows the player to be awarded a bonus award 116 from a set of bonus awards having associated award values. During play of the bonus feature game 66, the gaming controller 12 determines that the player has defeated the enemy symbol 118 if the selected player number is greater than or equal to the enemy symbol number, and responsively increase a value of the associated award values of the set of bonus awards 116. The gaming controller 12 may also display another enemy symbol, select a second enemy symbol number from the predefined range of numbers, and randomly select a second player number from the predefined range of numbers. In addition, in one embodiment, the gaming controller 12 may provide the player an option to choose between selecting an award from the set of bonus awards or continuing play in the bonus feature game 66. If the player elects to select an award, the gaming controller 12 randomly selects a bonus award from the current set of bonus award values, provides the selected award to the player and concludes the bonus feature game 66.

In addition, the gaming controller 12 may also determine if the player number is less than the enemy symbol number and responsively select the bonus award from the set of bonus awards including the corresponding award values and concludes the bonus feature game 66.

In method step 324, upon the conclusion of the bonus feature game 66, the gaming controller 12 completes the secondary game 64, identifies the current position location of the player symbol 98, stores the current player position 114 in the database 90 for use in a subsequent secondary game 64, and returns game play to the primary game 62.

Figure 22:
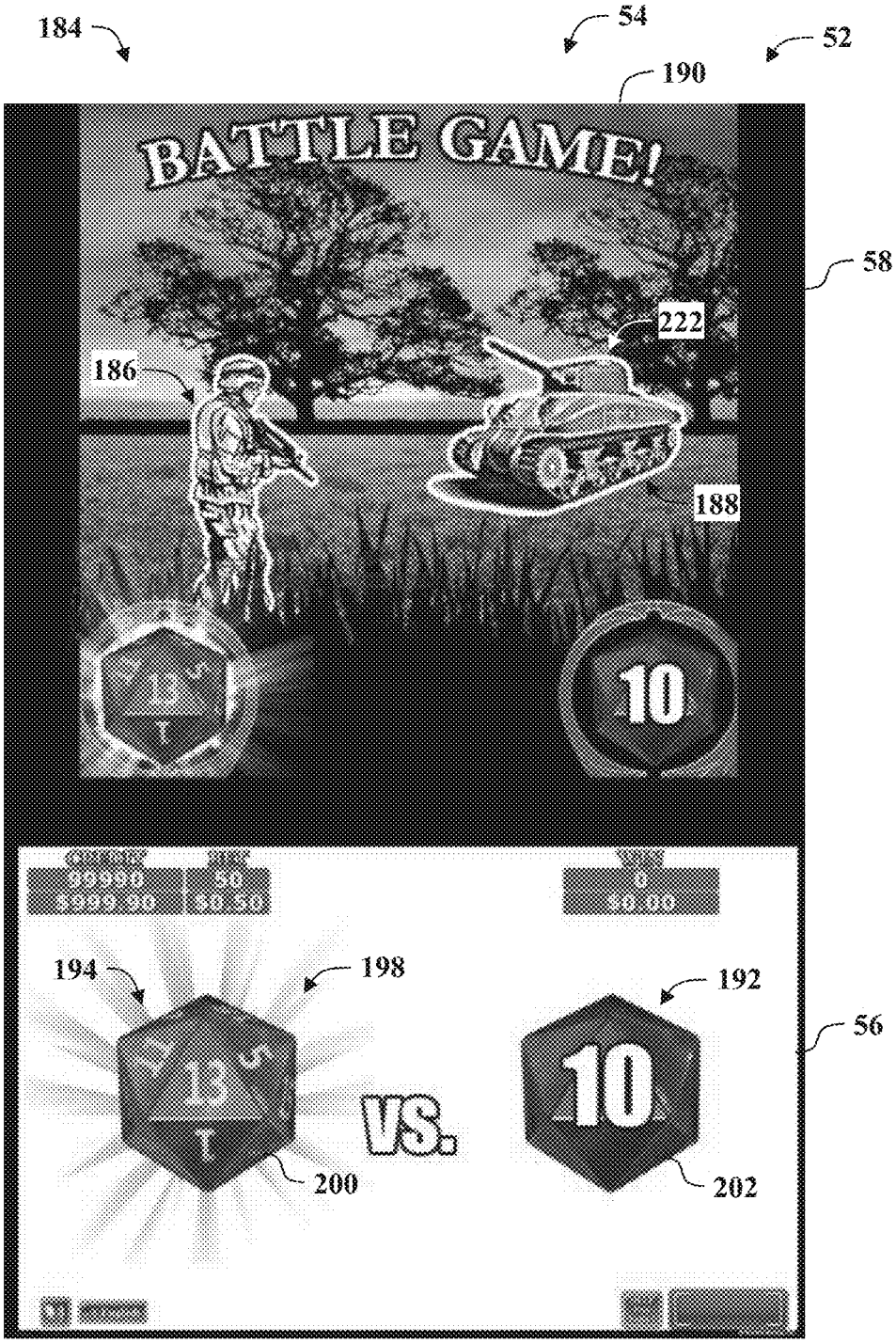
FIG. 22 is exemplary entertaining graphical display of a game screen including a bonus feature event that may be displayed with the secondary game shown in FIGS. 11-16, according to an embodiment of the present invention.

Referring to FIG. 22, in one embodiment, the bonus feature unit 104 may be configured to detect a triggering condition occurring with the primary game 62 and responsively display a secondary game 64 including a battle game 184. In addition, the bonus feature unit 104 may display the bonus feature game 66 including the battle game 184. The battle game 184 includes a player character 186 and an enemy character 188 being displayed on an animated game field 190. In the illustrated embodiment, the bonus feature unit 104 randomly select a first random number from a predefined range of numbers and associates the first random number with an enemy strength value 192 of the enemy character 188. The bonus feature unit 104 also randomly selects a second random number from the predefined range of numbers and associates the second random number with a player strength value 194 of the player character 186. The bonus feature unit 104 also determines an outcome of the battle game 184 including determining whether the player character defeats the enemy character 188 as a function of the player strength value 194 and the enemy strength value 192. For example, the first and second random numbers may be selected from a set of numbers ranging from 1-20.

The bonus feature unit 104 also provides an award to the player as a function of the outcome of the battle game 184. In one embodiment, the award is randomly selected from a set of secondary game awards 196 (shown in FIG. 27). Each of the secondary game awards 196 may include a different award value and an associated selection probability. In addition, each of the awards included in the set of secondary awards may be a progress award.

In the illustrated embodiment, the secondary game 64 includes a predefined number of enemy characters that may be defeated by the player character. In another embodiment, the number of enemy characters being included in the secondary game may be randomly selected, may be determined as a function of the triggering condition, and/or may be determined as a function of the wager placed with the primary game 62 and/or a player ranking associated with the player.

In one embodiment, the bonus feature unit 104 determines that the player character 186 does not defeat the enemy character 188 upon determining that the player strength value 194 is less than the enemy strength value 192. The bonus feature unit 104 also determines a current selection probability associated with each of the secondary awards 196, randomly selects the award as a function of the current selection probabilities, and provides the randomly selected award to the player and concludes the battle game 184. The bonus feature unit 104 may also, upon determining the player character 186 does not defeat the enemy character 188, determine a number of enemies previously defeated by the player character 186 and/or a number of rounds of the battle game 184 previously completed by the player during the secondary game 64 and determine the associated current selection probabilities as a function of the number of enemies previously defeated and/or the number of rounds previously played. In one embodiment, the selection probabilities and/or secondary award values may be determined as a function of a wager amount made by the player in the corresponding primary game 62.

In the illustrated embodiment, the bonus feature unit 104 determines that the player character 186 defeats the enemy character 188 upon determining the player strength value 194 is equal to or greater than the enemy strength value 192. In one embodiment, upon determining that player character 186 has defeated the enemy character 188 the bonus feature unit 104 modifies the selection probability associated with at least one of the secondary awards 196 included in the set of secondary awards to increase the probability of the player being awarded a higher value secondary award. In addition, the bonus feature unit 104 may determine if the secondary game 64 includes any additional enemies. If additional enemies are available, the bonus feature unit 104 generates a new enemy character 188 and initiates another round of the battle game 184. If there are no additional enemies available, the bonus feature unit 104 selects the award from the set of secondary awards 196 including the modified selection probabilities, provides the selected award to the player, and concludes the battle game 184.

In the illustrated embodiment, during the battle game 184, the bonus feature unit 104 may determine whether to initiate an attack bonus feature that increases the player strength value during a current enemy battle. For example, the bonus feature unit 104 may initiate an attack bonus feature upon determining the player strength value 194 is less than the enemy strength value 192. During the attack bonus feature, the bonus feature unit 104 randomly selects an attack bonus number and determines a modified player strength value 194 as a function of the attack bonus value and the current player strength value 194. In one embodiment, the bonus feature unit 104 adds the attack bonus number to the current player strength number generate the modified player strength value. The bonus feature unit 104 then determine the outcome of the battle game 184 as a function of the enemy strength value 192 and the modified player strength value 194. For example, in one embodiment, the bonus feature unit 104 may select the first and second random numbers from a set including a range between 1-20. If the second random number associated with the player strength value is less than the first random number associated with the enemy strength number, the bonus feature unit 104 may select an attack bonus number and add the attack bonus number to the second random number to determine the modified player strength value.

In one embodiment, the bonus feature unit 104 may determine a probability of initiating the attack bonus feature as a function of the current player strength value 194 and the enemy strength value 192. For example, the bonus feature unit 104 may determine a probability of initiating the attack bonus feature based on a numerical difference between the current player strength value 194 and the enemy strength value 192. In addition, the attack bonus feature may be initiated if the numerical difference between the current player strength value 194 and the enemy strength value 192 is within a predefined range. In one embodiment, the bonus feature unit 104 may randomly select the attack bonus number from a predefined set of attack bonus numbers with each of the attack bonus numbers having a corresponding selection probability.

In the illustrated embodiment, the bonus feature unit 104 displays a plurality of dice 198 on the animated game field 190 including a player die 200 associated with the player character 186 and an enemy die 202 associated with the enemy character 188. In additional, the player strength value 194 may be displayed with the player die 200 and the enemy strength value 192 may be displayed with the enemy die 202. In addition, the bonus feature unit 104 may animate the player die 200 and/or the enemy die 202 to simulate the player die 200 spinning and stopping to display the player strength value 194.

In one embodiment, referring to FIGS. 22-25, the bonus feature unit 104 may display an expandable image 204 that indicates the player strength value 194 with the player die 200. The bonus feature unit 104 may also display the expandable image 204 at a first size 206 and increase the size of the expandable image 204 to a larger second size 208 over a predefined period of time to notify the player of the currently player strength value 194. The bonus feature unit 104 may also display the enemy strength value 192 with an associated image having a predefined size, and increase the size of the expandable image 204 to the larger second size 208 that is the equal to the predefined size of the enemy strength value image.

Figure 24:
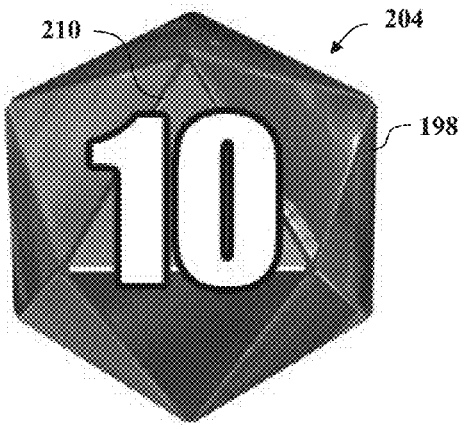
FIG. 24 is exemplary entertaining graphical display of an image of a game symbol image that may be displayed with the bonus feature event shown in FIG. 22, according to an embodiment of the present invention.

In one embodiment, the bonus feature unit 104 may display the player die 200 and/or the enemy die 202 having a number of sides equal to an amount of numbers included in the predefined range of numbers. Each side of the player die 200 and/or the enemy die 202 may be displayed with a corresponding number included in the predefined range of numbers. For example, the predefined range of numbers may include numbers 1-20. The bonus feature unit 104 may display a 20-sided die with each side displaying a corresponding number in the range. In one embodiment, each side of the player die 200 and or the enemy die 202 may be displayed with a planar face 210 having a triangular shape. In addition, the bonus feature unit 104 may display the expandable image 204 at the larger second size 208 such that a portion of the expandable image 204 extends beyond a perimeter of a corresponding side, as shown in FIG. 24.

Figure 25:
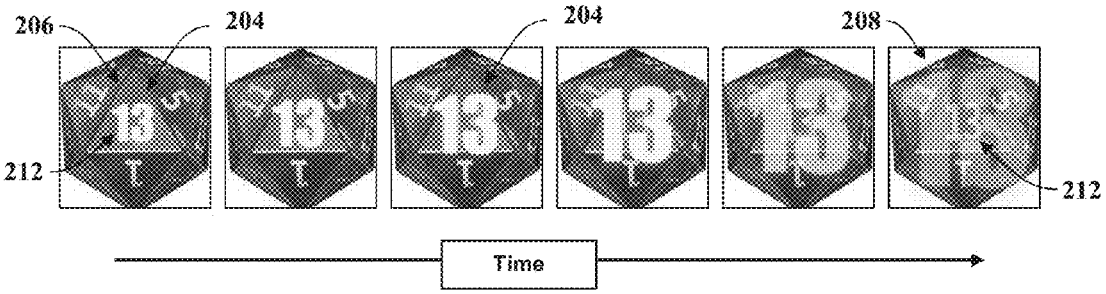
FIG. 25 is exemplary entertaining graphical display of the game symbol image shown in FIG. 24, according to an embodiment of the present invention.

In one embodiment, as shown in FIG. 25, the bonus feature unit 104 may display an initial image 212 of the player strength value with a side of the player die 200, and display the expandable image 204 overlaying the initial image 212 of the player strength value. The bonus feature unit 104 may then increase a transparency of the expandable image 204 over the predefined period of time such that the initial image 212 is visible through the expandable image 204.

Figures 23A, 23B, 23C:
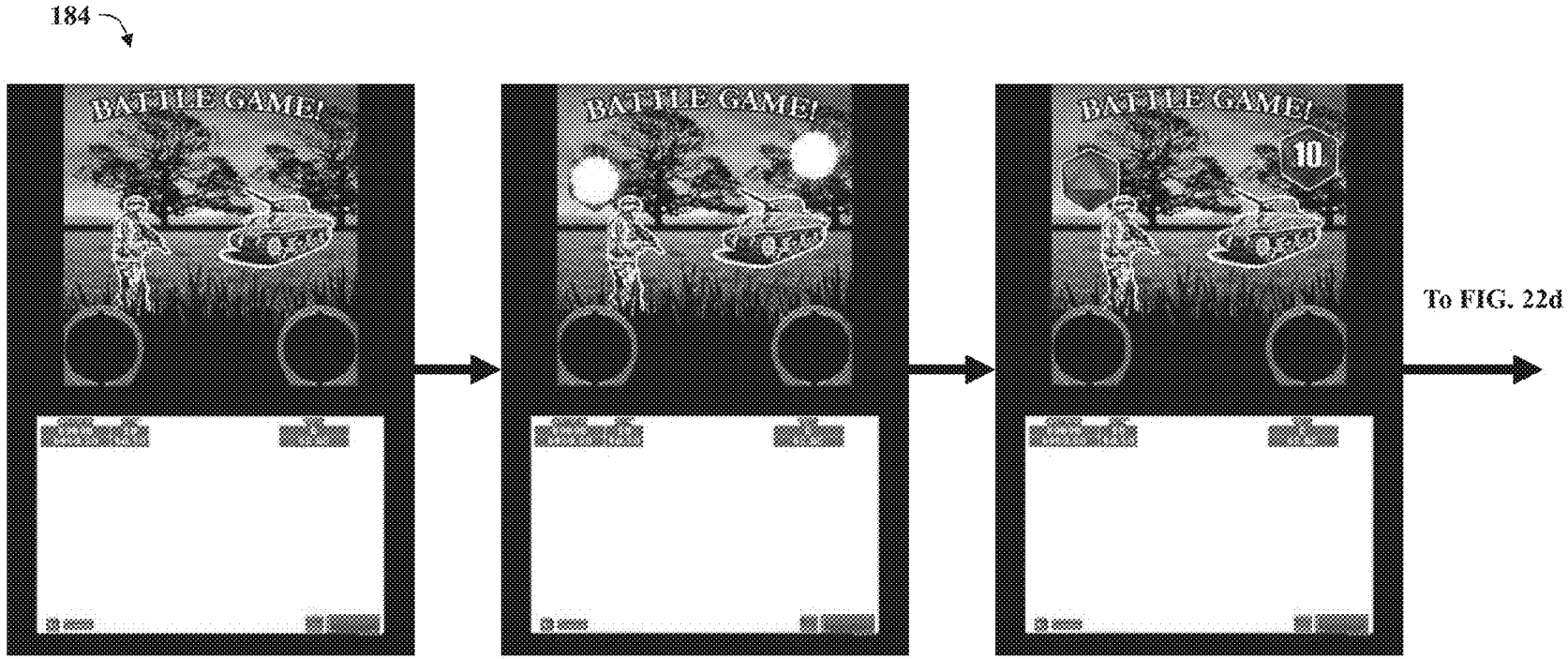
FIGS. 23*a*-23*h* are exemplary entertaining graphical displays of the bonus feature event shown in FIG. 22, according to an embodiment of the present invention.
Figures 23D, 23E, 23F:
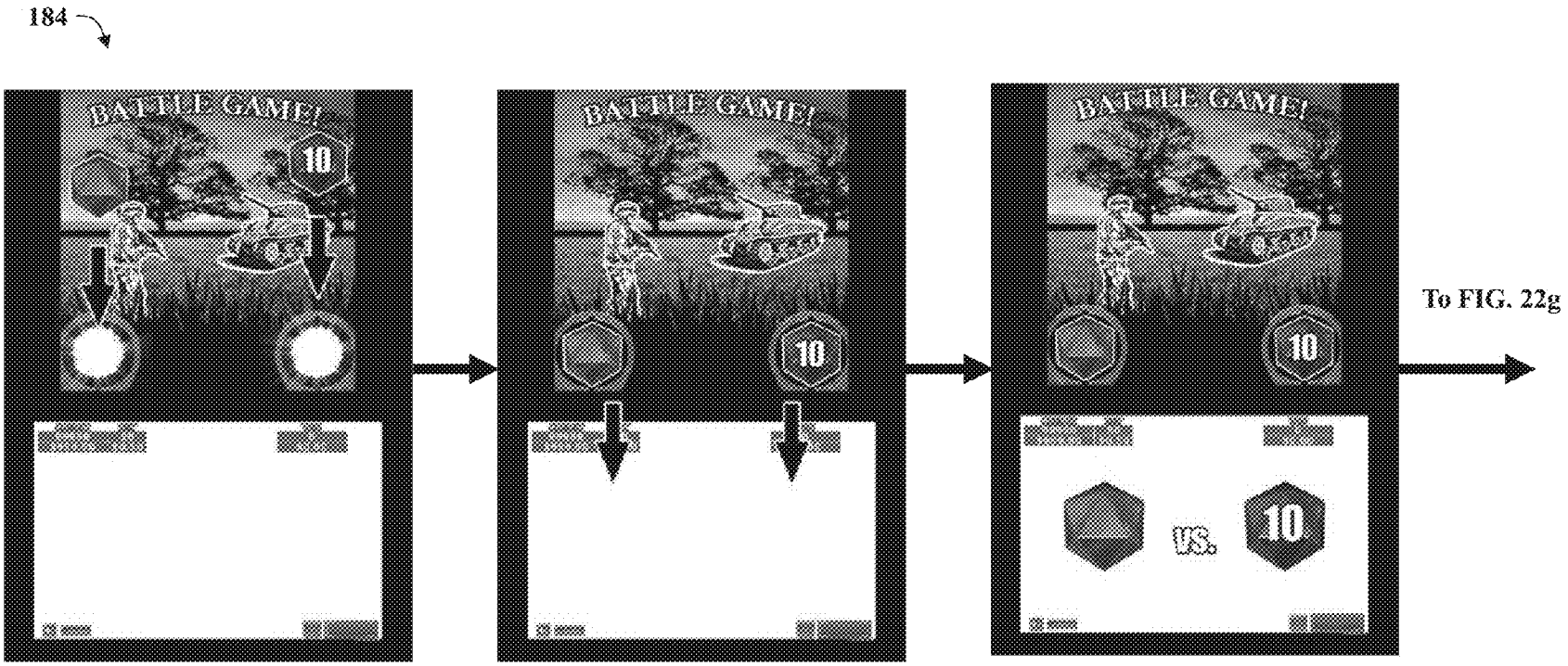
Figures 23G, 23H:
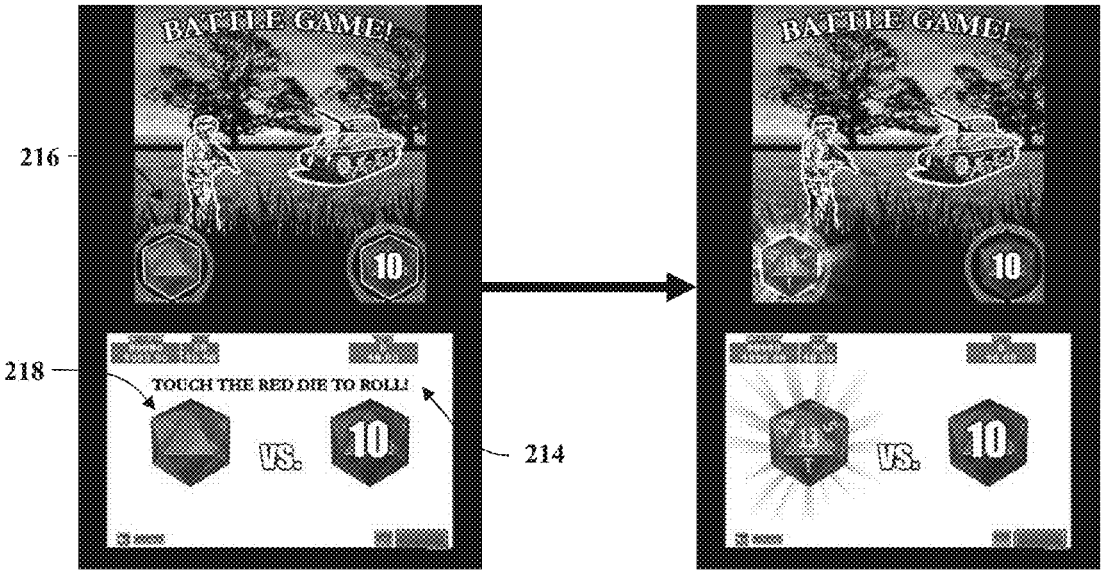

During the battle game 184, the bonus feature unit 104 may randomly select the player strength value 194 and initiate the battle game upon receiving a user input from the player via the user input device 16 and/or the display device 14. For example, in one embodiment, the bonus feature unit 104 may display a request notification 214 (shown in FIG. **23*g*) to the player to initiate a selection of the player strength value 194, and initiate the battle game 184 including randomly selecting the player strength value 194 and displaying the selected player strength value 194 on the player die 200 in response to receiving a selection from the player. In addition, as shown in FIG. 23*g*-23*h*, during the battle game 184 the bonus feature unit 104 may initially display a first player die 216 on the animated game field 190, and copy the first player die to display a second player die 218 on a player selection area 220 displayed in the display device 14 and/or the user input device 16. The second player die 218 may be similar to the first player die 216 and is selectable by the player to initiate a selection of the player strength value 194**.

In one embodiment, the bonus feature unit 104 may also select an enemy image 222 being displayed with the enemy character 188 as a function of the enemy strength value 192. The enemy image 222 may be selected from a predefined set of enemy images 222 stored in the database 90, as shown in FIG. 28. Each of the enemy images may be associated with a subset of the predefined range of numbers.

Figure 19:
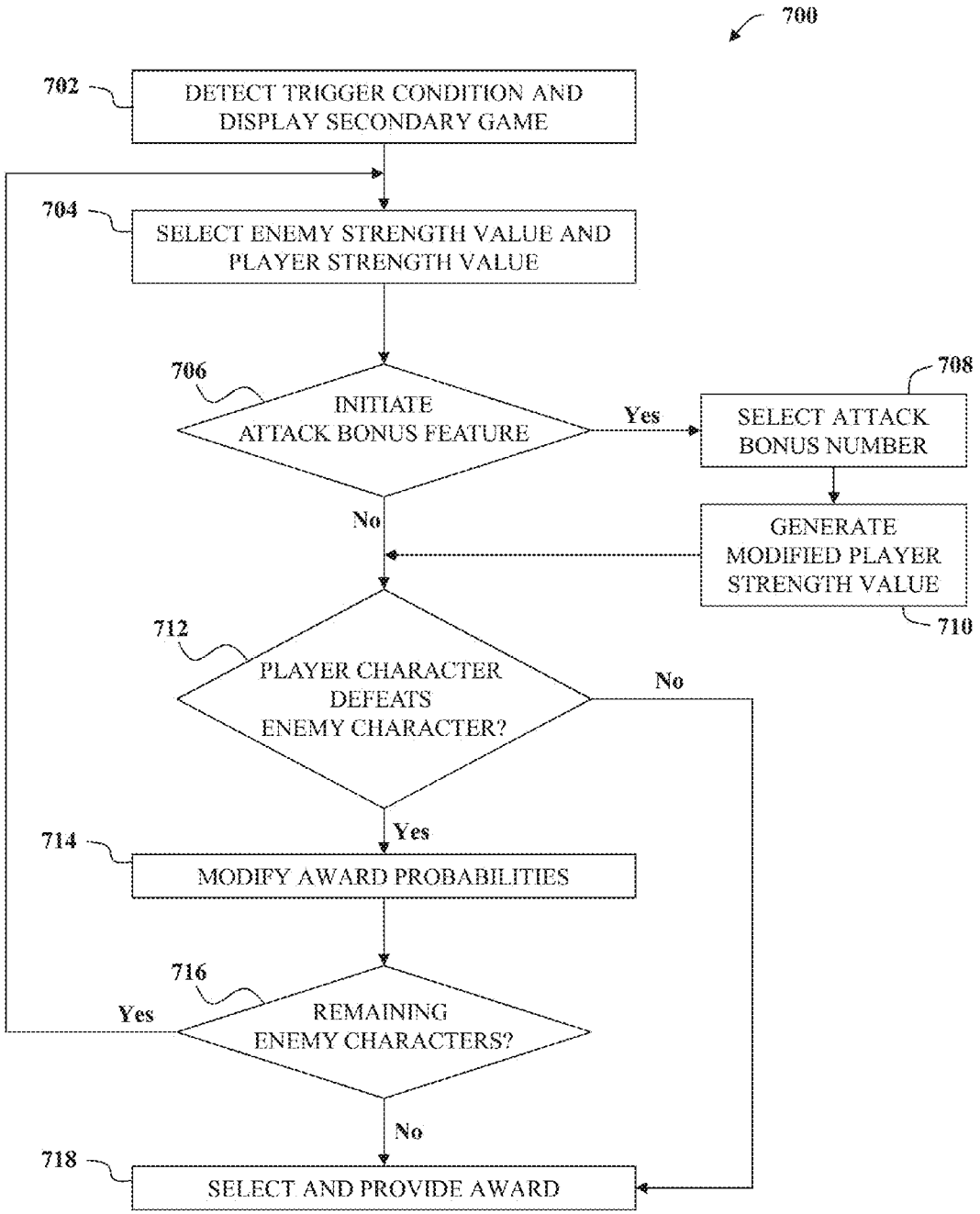
FIGS. 19-21 are flowcharts of methods that may be used with the gaming device shown in FIG. 1 for providing a secondary game to a player, according to an embodiment of the present invention.
Figure 20:
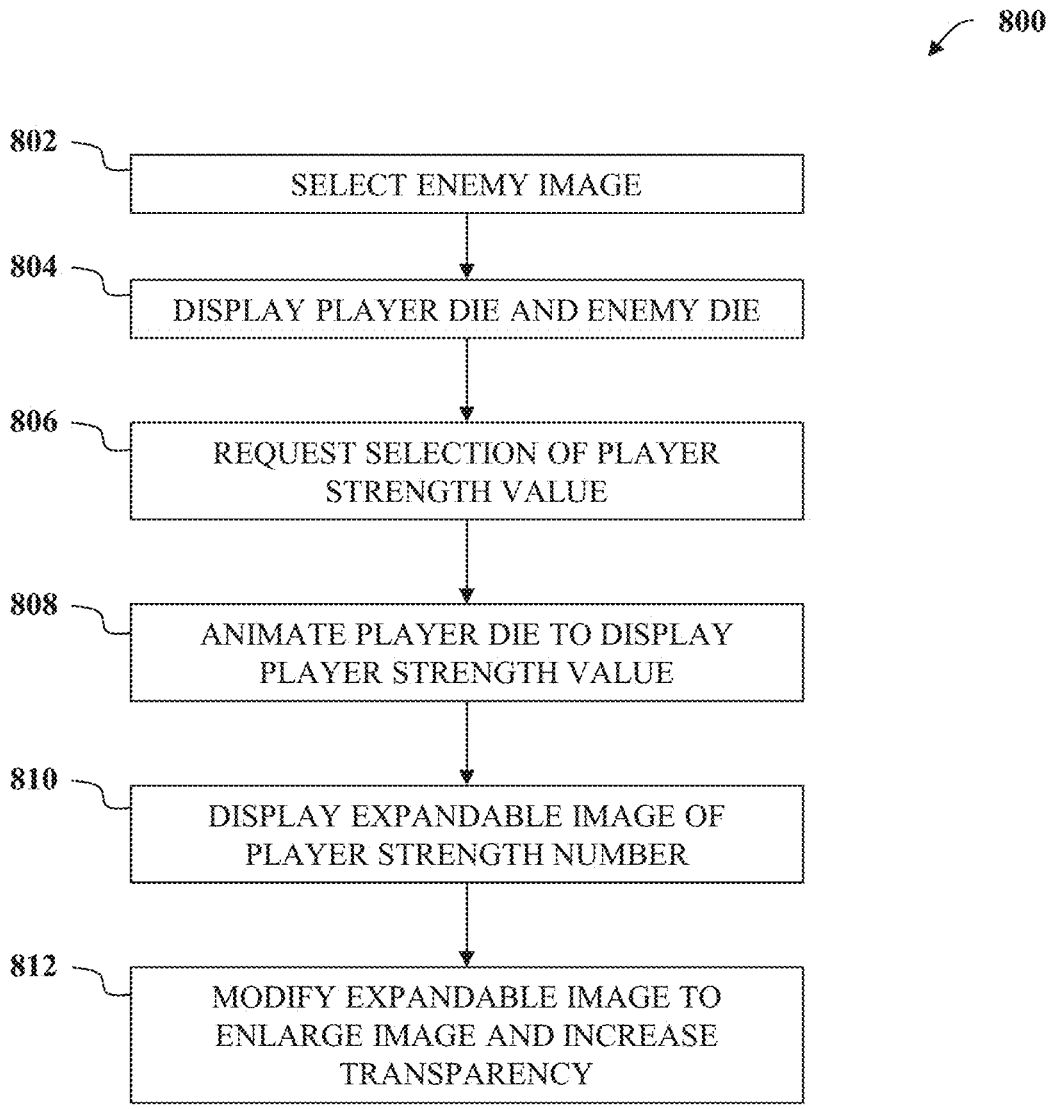
Figure 21:
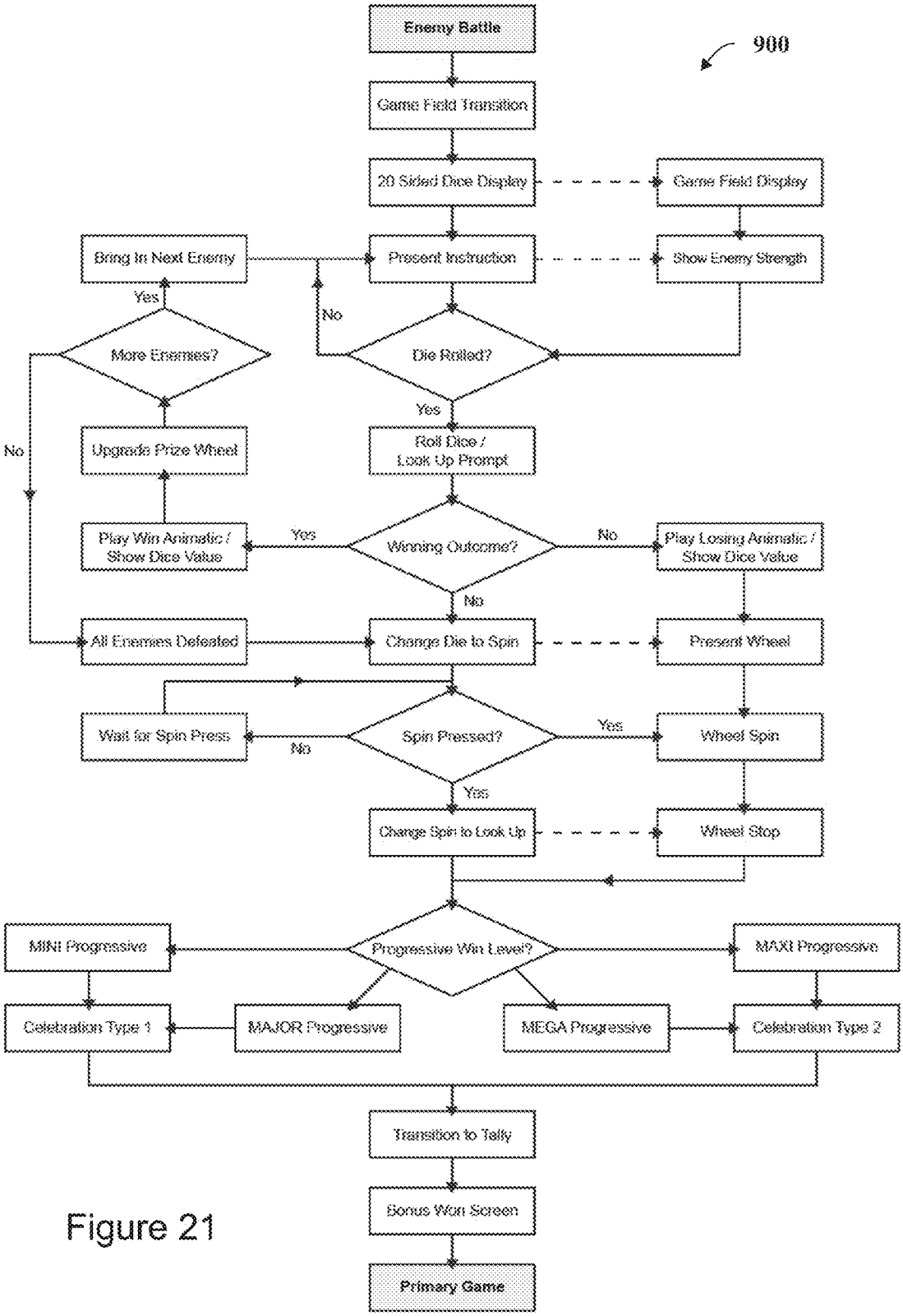

FIGS. 19-21 are flowcharts of methods 700, 800, and 900 that may be used with the gaming device 10 to provide a primary game and a secondary game to a player. The methods 700, 800, and 900 include a plurality of steps. Each method step may be performed independently of, or in combination with, other method steps. Portions of the methods may be performed by any one of, or any combination of, the components of the one or more gaming devices 10. FIGS. 22-25 are exemplary entertaining graphical displays of the secondary game 64 that may be played with the gaming device 10. FIGS. 26-30 are records contained in the database 90 that may be used by the gaming controller 12 during play of the secondary game 64.

In the illustrated embodiment, in method step 702, the gaming controller 12 randomly generates an outcome of the primary game 62, displays the outcome of the primary game 62 on the display device 14, detects a triggering condition occurring with the primary game 62, and responsively displays the secondary game 64 on the display device 14. In the illustrated embodiment, the gaming controller 12 displays the secondary game 64 including a battle game 184 that includes the player character 186 and the enemy character 188 being displayed on an animated game field 190.

In method step 704, the gaming controller 12 selects and enemy strength value 192 and a player strength value 194. In the illustrated embodiment, the gaming controller 12 randomly selects a first random number from a predefined range of numbers and randomly select a second random number from the predefined range of numbers. For example, in one embodiment, the predefined range of numbers includes number ranges from 1 to 20, however, it should be noted that any range of numbers may be used such as, for example 1-6, 1-12, 1-100, etc. In the illustrated embodiment, the gaming controller 12 determines an enemy strength value 192 as a function of the first random number and determines the player strength value 194 as a function of the second random number. The gaming controller 12 may then compare the player strength value to the enemy strength value to determine an outcome of the battle game 184 and determine whether the player character 186 defeats the enemy character 188. For example, in one embodiment, the gaming controller 12 may determine that the player character defeats the enemy character 188 if the player strength value 194 is equal to or greater than the enemy strength value.

In method step 706, the gaming controller 12 determines if an attack bonus feature is initiated during the battle game 184. During the attack bonus feature, the gaming controller 12 selects an attack bonus number and generates a modified player strength value as a function of the attack bonus number, and determines the outcome of the battle game 184 with the modified player strength value. In the illustrated embodiment, the gaming controller 12 initiates the attack bonus feature if the selected player strength value 194 is less than the enemy strength value 192. In one embodiment, the gaming controller 12 may determine a difference between the player strength value 194 and the enemy strength value 192, and initiate the attack bonus feature if the determined difference is within a predefined numerical range. The gaming machine 10 may also determine a probability of initiating the attack bonus feature as a function of the player strength value 194 and the enemy strength value 192, and initiate the attack bonus feature as a function of the determine probability. For example, in one embodiment, the gaming controller 12 may access an attack bonus data record 224 (shown in FIG. 30) being stored in the database 90, and determine a probability of initiating the attack bonus feature as a function of the player strength value 194 and the enemy strength value 192. For example, if the enemy strength value 192 is equal to 8, and the player strength value 194 is equal to 5, the gaming controller 12 determines the probability of initiating the attack bonus feature to be equal to 0.38%. The gaming controller 12 then randomly determines to initiate the attack bonus feature as a function of the selected probability.

In method step 708, upon initiating the attack bonus feature, the gaming controller 12 randomly selects the attack bonus number from a predefined set of attack bonus numbers 226. For example, in one embodiment, the gaming controller 12 may access an attack bonus number data record 228 (shown in FIG. 29) being stored in the database 90, and selects the attack bonus number 226 from the attack bonus number data record 228. As shown in FIG. 29, each number in the predefined set of attach bonus numbers has a corresponding selection probability. In one embodiment, the gaming controller 12 may randomly select the attack bonus number 226 as a function the associated selection probabilities being stored in the attack bonus number data record 228. The associated selection probabilities may be determined as a function of a wager value placed on the primary game 62, the triggering condition initiating the battle game 184, and/or a player ranking.

In method step 710, the gaming controller 12 generates a modified player strength value as a function of the selected attack bonus number 226. In one embodiment, the gaming controller 12 may add the selected attack bonus number to the current player strength value 194 to generate the modified player strength value 194. For example, if the current player strength value is equal to 5, and the selected attack bonus number 226 is equal to 4, the gaming controller 12 may generate the modified player strength value equal to 9 (i.e., 5+4=9).

In method step 712, the gaming controller 12 determines whether the player character 186 defeats the enemy character 188 as a function of the enemy strength value 192 and the current player strength value 194 and/or the modified player strength value 194. In the illustrated embodiment, the gaming controller 12 determines the player character 186 to defeat the enemy character 188 if the player strength value 194 is equal to, or greater than, the enemy strength value 192. In addition, the gaming controller 12 determines the enemy character 188 defeats the player character 186 if the player strength value 194 is less than the enemy strength value 192.

Upon determining that the player character 186 does not defeat the enemy character 188, the gaming controller 12 proceeds to method step 718. In method step 718, the gaming controller 12 initiates a jackpot decision feature and selects an award from a set of secondary game awards, and provides the selected award to the player. For example, referring to FIG. 27, in one embodiment, the gaming controller 12 access secondary award data records 230 being stored in the database 90, and selects a secondary award 196 from the set of secondary awards included in the secondary award data records 230. Each of the secondary awards 196 may include a different award value and an associated selection probability. The gaming controller 12 randomly selects a secondary game award as a function of the associated selection probabilities. In one embodiment, each secondary award 196 may include different selection probabilities associated with each round of the battle game 184 and/or the number of enemies previously defeated by the player. For example, upon determining the player strength value is less than the enemy strength value, the gaming controller 12 may determine a number of enemies previously defeated by the player character 186 during the battle game 184, and determine the associated selection probabilities as a function of the number of enemies previously defeated, and select an award based on the determined selection probabilities.

In one embodiment, the gaming controller 12 may initiate a defeat fatigue feature to display the jackpot decision feature before a defeat of the player character 186 is displayed to the player. For example, in one embodiment, the battle game 184 may include a total of 10 rounds and/or battles. On each battle, the gaming controller 12 decides if the player wins or loses each of the rounds, and may determine a small probability of a player completing all 10 rounds of the battle game 184. To alleviate a defeat fatigue experienced by the player. The gaming controller 12 may display an "end" scenario on the battle before the player would lose. For example, if the gaming controller 12 determines that the player character 186 will lose on battle 3, the gaming controller 12 may access a defeat fatigue data record 232 (shown in FIG. 26) stored in the database 90 to determine whether to provide an end scenario display after completing round 2. The gaming controller 12 may determine a 30% chance that after battle 2, the gaming controller 12 may just "end" the bonus battle game 184 and initiate the jackpot bonus feature.

Upon determining that the player character 186 defeats the enemy character 188, the gaming controller 12 proceeds to method step 714. In method step 714, the gaming controller 12 modifies the selection probability associated with one or more of the secondary awards 196 included in the set of secondary awards to increase the probability of the player being awarded a higher value secondary award. For example, in one embodiment, the gaming controller 12 may increase the probability of obtaining a higher award such as, for example a MAXI award. The gaming controller 12 may also display a prize ring 234 (shown in FIG. 18) that illustrated the current probability of obtaining each of the secondary awards. The prize ring 234 may be displayed with one or more wedges 236 that corresponding to a particular secondary award. The size and/or number of wedges 236 being displayed in the prize ring 234 indicates the probability of receiving the corresponding prize. For example, in one embodiment, as the battle game 184 is initiated, the gaming controller 12 may display a prize ring 234 that includes 174 wedges/97.50% area associated with a MINI award, 4 wedges/2.00% area associated with the MAJOR award, 1 wedge/0.30% area associated with the MEGA award, and 1 wedge/0.20% area associated with the MAXI award. When players defeat an enemy, the prize ring 234 is upgraded to be visually shown to the player. In general, Mini wedges will decrease in number and the Major wedges will increase. Then, with continuing upgrades, the Major wedges will decrease in number and the Mega wedges will increase, to indicate an increase in the probability of obtaining a higher valued prize award.

In method step 716, the gaming controller 12 determines if any remaining enemy characters are included in the battle game 184. If no additional enemy characters are available, the gaming controller 12 proceeds to method step 718 and initiates a jackpot decision feature and randomly selects a secondary award and provides the award to the player. Upon determining that additional enemy characters are available, the gaming controller 12 proceeds to method step 704, and initiates another round of the battle game 184.

In the illustrated embodiment, the gaming controller 12 may also implement method 800 and/or method 900. Referring to FIG. 20, in one embodiment, in method step 802, upon initiating the battle game 184, the gaming controller 12 may select an enemy image 222 being displayed with the enemy character 188 as a function of the enemy strength value 192. The enemy image 222 may be selected from a predefined set of enemy images with each of the enemy images being associated with a subset of the predefined range of numbers. For example, in one embodiment, the gaming controller 12 may access an enemy image data record 238 (shown in FIG. 28) being stored in the database 90 to select an enemy image 222 being displayed with the enemy character 188 based on the enemy strength value 192.

In method step 804, the gaming controller 12 displays the battle game 184 including a plurality of dice 198 being displayed on the animated game field 190. In the illustrated embodiment, the gaming controller 12 displays a player die 200 associated with the player character 186 and displays an enemy die 202 associated with the enemy character 188. For example, referring to FIG. 22-25, in one embodiment, the gaming controller 12 displays a visually complex bonus game event dealing with competition or battle. The gaming controller 12 also displays a simplified game mechanic, such as a dice roll, to allow players to understand what is occurring during the bonus game. In one embodiment, both the player character and the enemy character would both roll dice, however, in another embodiment, but for speed and tempo of game play, the enemy character will be given a randomly designated number and that number will be shown on an already rolled dice.

Displaying the relationship of each character's dice to the character is very important in the bonus game setup as well. The series of images shown in FIGS. 23*a*-23*h* illustrate how each character's dice relate to the character and how the information is visually passed down to populate user interface meters. The sequence of events shown in the images displayed in FIGS. 23*a*-23*h* are meant to be animated fairly quickly—roughly 2 to 3 seconds—so players playing the gaming machine 10 will be able to navigate their visual focus from top screen to bottom screen and initiate the bonus game event. For example, in one embodiment, the gaming controller 12 displays a battle that includes the player character 186 and the enemy character 188. The two characters are located in the top screen of a dual screen video slot product. At the bottom of the top screen is a user interface to house the dice that appear on the top screen, while on the bottom screen is where the dice will be copied to in order for the player to have interaction with their dice. The first set of frames shown in FIG. 23*a*-23*c*, an effect appears in the vicinity of each character, then dice associated with each appear in close proximity to the respective characters. The enemy character may already have a rolled value shown on the dice. This establishes the initial relationship of the respective dice with the characters. In the next set of frames shown in FIG. 23*d*-23*f*, the dice that appeared next to each character will animate down to populate the user interface located at the bottom of the top screen display. Then, after holding briefly holding in that location, the two dice will be copied down to the bottom screen display. This further reinforces the relationship of the dice with the characters.

In method step 806, the gaming controller 12 displays a request notification 214 to the player to initiate a selection of the player strength value 194. For example, referring to FIGS. 23*f* and 23*g*, after the dice are copied down to the bottom screen display, the rest of the bonus event's wording will appear and the player will be prompted to touch their (red) player dice 200 to roll it.

In method step 808, the gaming controller 12 receives a selection from the player, e.g. the players touches a touchscreen displaying the associated player die 200, randomly selects the player strength value 194, and animates the player die 200 to simulate the player die spinning and stopping to display the player strength value 194.

In method step 810, the gaming controller 12 displays an expandable image 204 of the player strength value 194 on the player die 200. In method step 812, the gaming controller 12 modifies the expandable image 204 to increase the size and the transparency of the expandable image 204. For example, in an effort to maximize the readability of the numeric value shown on a multisided die and to emphasize which side of a multisided die is facing the viewer/player, the value of the chosen number will be graphically enlarged. The gaming controller 12 may be configured to provide two implementations, one for the enemy character and one for the player character. For the enemy character, a pre-determined (random) strength number is generated. This value is shown on the enemy die 202. For ease of legibility, the values on the die are not shown except for the value that the enemy strength value has been given. FIG. 24 displays how the number exceeds (in this case) the three angles that make up the "side" of the die. For the player character, a dice roll will be shown. In order to maximize the realistic nature of the dice roll, the dice will utilize "normal" sized numbers—one for each side—and placed within the three angles that make up the side of the die. When the player die rolls and lands, a graphical effect will play atop the side of the die to enhance (or show larger) the value of the player strength value 194 on that specific side of the die before fading out of sight. FIG. 25 illustrates an animated sequence that represent what happens when the player die 200 lands on a number (essentially, after the roll of the die completes).

In the illustrated embodiment, the gaming controller 12 is configured to provide a Battle Game including a Multiple-Lines 3-3-3-3-3 Xtra Reward video slot product. The game will use original math which contains the following bonuses: Free Game Feature: This bonus is triggered by 3, 4 or 5 scatter symbols. When free games are triggered, players win 15, 20, or 25 free games. Main Bonus Feature: This feature is mystery triggered. When triggered, players play up to a 3-tiered nested bonus feature: a map picking portion, a battle portion, and a jackpot decision portion where the jackpot decision portion awards one of 4 progressive levels (Maxi, Mega, Major, and Mini).

The main bonus feature is mystery triggered, and can occur after any bought game. When triggered, the game plays a transition and players start the bonus on a virtual game field that occupies both the bottom screen and a top Monument game screen. The game field is shown from the perspective of a "top down" view. The player's character is shown on the field in the center of the bottom screen (shown in FIG. 11-17). Directional arrows are shown around the character (only showing the directions in which the character can move). When players select a direction to move their character on the game field, the field dynamically scrolls with a short delay either left, right, up, or down so the player's character is always nearly centered on the bottom screen.

During the game field navigation portion of the bonus, one of 3 events may occur: 1) Discover a Weapon/Treasure—player receives awards credits and continues play; 2) Discover a Trap—player ends the bonus round; and 3) Discover an Enemy—player triggers enemy battle and jackpot decision bonus. During Discover a Weapon/Treasure, a quick animation of the object appearing on the game field shows along with a winning amount of credits. Credits are then counted in the bonus meter and players select another game field location to move to. When a credit amount is awarded to the player, it always occurs at the end of the character's travel on the game field. During the Discover a Trap, finding a trap plays a short animation that shows the player that the bonus round has ended. A quick transition then brings the player back to the primary game screen. When a trap is to be awarded to the player, it always occurs while the character is travelling on the game field.

During the Discover an Enemy, when an enemy is discovered, a progressive jackpot win is guaranteed. When an enemy is discovered, the progressive jackpot win can be awarded during the character's travel or after the character reaches their destination on the game field. The game then transitions to a battle scene where the player's character must fight enemies. When fighting an enemy, one roll of a 20 sided dice occurs. The value that the player rolls must tie or exceed the value the enemy has in order to win. The enemy has a predetermined strength value (number); the higher the number, the more challenging it is to defeat the enemy. Defeating an enemy awards an upgraded progressive ring—which is shown continuously underneath the player's character and enemy they are battling throughout the duration of the Enemy Battle bonus. This typically then triggers another enemy battle where the above process is repeated with the same or a different enemy. The longer the player is in the fighting portion of the bonus, the more the player collects upgrades to be used in the Jackpot Decision bonus.

There exist 2 ways the Enemy Battle Bonus ends: 1) losing against the enemy ends the fighting portion of the bonus and sends the player to the Jackpot Decision bonus; and 2) to prevent "defeat fatigue", occasionally, players will be told that they've defeated all enemies. This in turn ends the Enemy Battle Bonus as well.

The Jackpot Bonus Decision, this bonus may occur simultaneously with the enemy battle bonus, but its functionality is secondary until the player is defeated by an enemy (or players defeat all enemies). When players are fighting an enemy, they will likely notice the colored ring on the game field. This is the progressive ring and contains all possible winning progressive levels in the jackpot decision game—mathematically represented by what chance the player has of winning a certain level of progressive.

Initially, the player starts with a ring that is composed of the following spots: 1) MINI: 174 wedges/97.50% area; 2) MAJOR: 4 wedges/2.00% area; 3) MEGA: 1 wedge/0.30% area; and 4) MAXI: 1 wedge/0.20% area. In one embodiment, the wedges are equally spaced around the ring (for example, the Mega wedge is 180 degrees away from the Maxi wedge and the Major wedges are distributed 90 degrees apart from each other around the ring, but equidistant from the Mega and Maxi wedges).

When players defeat an enemy, the progressive ring will upgrade. The upgrade will be visually shown to the player. The general premise is that the Mini wedges will decrease in number and the Major wedges will increase. Then, with continuing upgrades, the Major wedges will decrease in number and the Mega wedges will increase, and so on. Ultimately, there are 20 iterations of the progressive ring with the final ring being primarily Mega and Maxi wedges with very few Mini and Major wedges.

Players continue bonus play against enemies, and the progressive ring will upgrade every time they defeat an enemy; they will visually be able to tell that their potential ending prize is increased. Play continues until the player is defeated by an enemy or all enemies have been defeated. When defeated by an enemy, the enemy disappears and the camera view changes to a top-down view of the game field; a wheel pointer appears, the player is prompted to press a spin button, and when they do so, the progressive ring (now really a wheel) then accelerates, spins, decelerates, and slows to a stop. The progressive level prize the pointer points to is awarded to the player and short celebration plays; the bonus game then ends.

In the illustrated embodiment, the gaming machine 10 is configured to initiate an Attract Mode. When no money is in the gaming machine, the gaming machine displays dynamic Electronic-art on the display including an enemy and player character in the process of fighting during the progressive bonus. The camera pan and parallaxing would be the only animation for its "dynamic" parts. This may show off one of the enemies and the character chosen for the game. The progressive meters and subtitle should be visible during the attract mode. Note that the attract mode may only shown on the upper Monument display.

When the game is active (i.e. a player puts money into the machine), the attract mode will change to the primary game art. When the game becomes inactive (i.e. a player cashes out and leaves the game), the screen will transition back to attract mode (Monument display only).

During the primary game, progressive meters reside at the top of the Extended Tall Top Box (ETTB) display, the progressive values shrinking in size from the Maxi (located at the very top) to the Major/Mini (located at the bottom). The progressive meters will odometer up in value as the game is being played. The design of the progressive meters will be the same as other progressive games with the intention to save on graphic space. Below the progressive meters resides the game's subtitle. Below the game's subtitle and extending to the bottom of the ETTB, a 5×6 reel array is shown in a locked state. On the bottom screen, the reel array is a 3×5 grid with the standard credit meters and buttons placed in their appropriate locations. The Xtra Reward logo is present centered at the top of the bottom screen. A triggering statement that will reside above the reels will only mention how the progressive bonus is triggered: "THE BATTLE FEATURE IS MYSTERY TRIGGERED."

Reel symbols for each game involve subject matter elements that the player will experience during the course of play when at the game. Reel symbols may include: Wild is worth emphasizing very much—the pay is much higher than any other symbol (300 vs next highest=150); To emphasize and work with 3 or 9 symbol high arrangements, an oversized 3 symbol high character will be used for the Wild in addition to an oversized head shot of the character for the single symbol wild. If the design can be tiled such that 3 stacked characters seem as one seamless design, great; Pic-A is a rather distant 2nd in importance behind Wild/DASS. Perhaps showing it as single symbol is best, but designed with stacking in mind since it will be seen in stacks on all reels; and Pic-C and Pic-D are currently a pay grouping; they pay the same.

Dynamic Action Stacked Symbols (DASS) Feature—a Frame Feature. When at least 3 reels in the main game (on the bottom screen) have Action Stacked Symbols, any wins created are paid. Then in rapid succession, the top game unlocks, the Action Stacked Symbols expand to occupy the entire reel that they are on, and the symbol changes to another symbol. Any resulting wins are then paid (if they exist). Notes about the DASS feature: The DASS frame and reveal effect is worth emphasizing very much. The win distribution increases pretty dramatically when DASS occurs; To combine the above two, the largest win scenarios occur when Wild is revealed by DASS. Maybe some design elements could be common to Wild and DASS frame (and/or reveal effect); Let's make some bit of theme-related design in DASS frame and/or reveal effect. Powerful and appealing; and For the DASS reveal effect, imagine a quick explosion during the action to emphasize the quickness of the nudge and transition to the new symbol.

In one embodiment, Five of a Kind Wins During Primary Game: If a 5 of a kind occurs during the primary game, the 5 of a kind celebration will be used.

Free Game Feature: 3, 4 and 5 Scatter Symbols awards 5, 10 and 20 free games respectively. All games (meaning both bottom screen and Monument game screens) are active during the free games.

Trigger Banner: When the trigger symbols land, the trigger banner appears to display the number of free games awarded: 5 Free Games Won; 10 Free Games Won; 20 Free Games Won. Players are then prompted to press the spin button to activate the free game bonus.

Transition to Free Games: When the spin button is pressed, a white fade transition engulfs the entire top and bottom screens (with the exception of the progressive meters and subtitle). When the transition dissipates, while the background remains the same, the number of free games counts up (at the top of the bottom screen), and the top game has already been unlocked and the reels active. The free games then commence.

Double Action Stacked Symbols (DASS)—a.k.a. "Frame Feature": When at least 3 reels in any game have Action Stacked Symbols, any wins created are paid. Action Stacked Symbols are then expanded to both games and a different Action Stacked Symbol is selected. Any resulting wins created are paid. Again, the same technique used to show DASS in the primary game should be used again in the free game feature.

Retrigger Condition: 3, 4 and 5 Scatter Symbols during free games awards an additional 3, 4 and 5 free games respectively.

Retrigger Banner: 3 Additional Free Games Awarded; 4 Additional Free Games Awarded; 5 Additional Free Games Awarded Five of a Kind Wins During Free Games: If a 5 of a kind occurs during free games, the 5 of a kind celebration will be used.

Transition Back to Primary Game: When the free games end, a white fade transition engulfs the entire top and bottom screens (with the exception of the progressive meters and game subtitle). When the transition dissipates, the top game has already been locked back up and the reels have become inactive.

Main Bonus Feature: When the main bonus feature is triggered an explosive transition will be used as the transition to the main bonus feature of this product (but not covering the progressive meters or game subtitle). When the main bonus feature is triggered, the exploding background will be the background for the banner that will appear on the bottom screen announcing to the player that they've won the bonus feature. Text on the bottom screen will include the following: "BATTLE FEATURE TRIGGERED, THE BATTLE FEATURE HAS A _____ SECOND TIME LIMIT. IF A DIRECTION IS NOT SELECTED WITHIN _____ SECONDS, A DIRECTION WILL BE SELECTED AUTOMATICALLY".

Note that the second statement above is if the time limit feature is enabled. If it is enabled, this statement should not be overly prominent on the screen as the "Battle Feature Triggered" statement is. After holding on this screen for 4 seconds, the top and bottom screens will fade to black briefly (except for the progressive meters and subtitle), again, using a fade to black transition. The screen will then fade up revealing the Battle Feature map.

Battle Feature: The Battle Feature opens with a fog of war (on both top and bottom screens) overlaid on top of a giant game field map that occupies both the top and bottom screens of the game. Room is left on the top screen for the progressive meters and the game subtitle. The map is designed in such a way that the player will feel like they can traverse a portion of the map, but not the entire map, as shown in FIGS. 11-17.

Game Field Map: The game field map is a "never ending" map, basically meaning that the map loops back upon itself creating an infinite loop of gameplay. Also incorporated into this is the idea of persistent state—a player starts the bonus in one location (A) and eventually travels to point (B) by the time the bonus ends. When the next bonus is initiated, the player starts at point (B) and travels from there. The map itself will be a series of paths on a game field. Random placement of items such as gold, rocks, trees, buildings, etc. will provide additional variation in the design of the game field.

Metering: Standard credit meters reside on the bottom screen along with a "Bonus Won" meter located in the same area that the Xtra Reward logo resided in during the primary game and free games (it will not be shown in this bonus).

Game Play: The way the Battle Feature works to the player will be rudimentary, but allows for much anticipation and excitement. Players start with their character located at the center of the bottom screen in one of the random starting locations. Players are then prompted to select a direction—N, S, E and/or W—depending on which open directions are available to the player. For instance, if the player's character is down a dead end path, the character will only have one direction to travel; if the player is in a corner, 2 directions, a T-intersection, 3 directions, and a crossroad, 4 directions. These will be dynamically shown as selectable directional arrows on the screen and also as arrows on the digital button panel. Again, a timer will be required for the selection part of this bonus game. When players select a direction, the character on the game screen then moves in that direction. The objective of character travel is that the character will encounter a trap, an enemy, or a credit prize. What denotes the end of travel are one of the following: a corner, a T-intersection, a 4-way intersection, or a dead-end.

Discovering a Credit Prize: If the player discovers a credit prize, it is imagined that a prize icon will pop out and appear as the character stops. The prize itself can be a treasure chest, weapon, or other item of value; as long as it looks like a prize icon and a credit value can be associated in the vicinity of it. The credit value will be dynamic in the sense that the higher the player bets to trigger the bonus, the larger the credit prize will be. The credit amount will count up in the bonus meter and the item will disappear off of the game screen.

Discovering a Trap: If the player discovers a trap, it ends the bonus game. The following are the traps in the game; there are 2: 1) Pit Trap: The path opens into a cavernous pit, where the camera follows the character into the pit, which essentially provides a black screen for transition back to the primary game; and 2) Net Trap: Character engulfed in a net and then disappears off screen, leaving behind their weapons.

Discovering a trap will produce the unintended consequences on the game field. The game will then display a transition to the tally screen where the player's credit award will be displayed. The white fade will then be introduced to bring the player back to the primary game screen.

Discovering a Enemy: If the player discovers an enemy, it ends the game field portion of the bonus game and triggers the Enemy Battle Feature. The camera swings down on the game field into the area where the player's character is located and swings around the character, initiating the Enemy Battle Feature.

Enemy Battle Feature: The Enemy Battle Feature uses a combination of 2D art and RT3D art. The player's character in this portion of the bonus faces off against a succession of enemies of random type and difficulty. Defeating an enemy awards an upgrade to a progressive prize wheel. Two cases exist and both trigger the Jackpot Decision Feature: being defeated by an enemy or defeating a random select number of enemies.

The setup of the bonus game is the following: players are presented on the top screen with the view of the player's character, the slowly rotating prize wheel ring, an empty UI on the bottom of the ETTB display, and an empty UI on the bottom display.

Then, simultaneously, the player's dice, the random enemy that they are going to fight, and two dice appearing the vicinity of each respective character appear; the enemy's die having the numeric value of its strength from 1 to 20 (again, both of these characters are located within what will eventually become the progressive prize wheel).

Next, the two dice shine and "whoosh" down to the ETTB UI display, populating it. Shortly thereafter, the dice shine again and populate the bottom screen UI. Next, a prompt for the player to touch the die to roll it along with a disclaimer about the time limit for the die roll: "PRESS SPIN OR TOUCH THE DIE TO ROLL, THE ENEMY BATTLE FEATURE HAS A _____ SECOND TIME LIMIT. IF THE SPIN BUTTON IS NOT PRESSED TO ACTIVATE THE FEATURE WITHIN _____ SECONDS, THE FEATURE WILL ACTIVATE AUTOMATICALLY."

When players touches the die, the die on the bottom screen will animate the roll and prompt the player to look up to the top screen while an associated success or fail animatic is then played out on the top screen depending on whether or not the player's number ties or surpasses the enemy's strength number (note that the player can also continue to look at the bottom screen to just see the dice rolling action). This action is accomplished by the following: The player's die plays a general roll for about a half second (exact time TBD); Randomly, an added "power up value" of +1-+3 will be applied to the dice. This occurs if the player's dice value stops near or below the value of the enemy's strength value and needs that extra "push" to try and pass the enemy's value. It should be noted that this power up value will not always be successful when awarded; If applied, the die plays a random segment of counting up from 1 to 3 beats. The count up is a sequential display of numbers to build anticipation for the player. As an example, if the dice would randomly roll and then show 8 . . . Power Up Award! . . . 9 . . . 10, stopping on the 10; At the end of the count up, the final value of the die is shown and the outcome of the animatic is played.

A winning scenario shows an effect behind the dice to emphasize a win and the animatic on the top screen shows a victorious scene along with a banner that states: "VICTORY! UPGRADE AWARDED!"

The fighting process is repeated again until they lose or until all enemies in the bonus are successfully defeated. If the player loses a battle, the fail animation plays and the Jackpot Decision Feature is initiated. If the player defeats all of the enemies—a banner will appear during the victory portion of the animation that states: "VICTORY! ALL ENEMYS DEFEATED! UPGRADE AWARDED!" After holding on the banner for 3 seconds, the prize wheel positions will upgrade and the player will then be taken to the Jackpot Decision Feature During a visually complex bonus game event dealing with competition or battle, it is sometimes necessary to display a simplified game mechanic, such as a dice roll, to allow players to understand what is occurring during the bonus game. The assumption is that the player has a character that they are controlling and the gaming device has another character that it controls. The two characters during the bonus game event are competing against each other and the method to determine the outcome of the competition is by comparative dice roll.

In a desired implementation, both the player's character and the gaming device's character would both roll dice, but for speed and tempo of game play, the gaming device's character will be given a randomly designated number and that number will be shown on an already rolled dice.

Displaying the relationship of each character's dice to the character is very important in the bonus game setup as well. The series of images shown in this section of the document will help illustrate how each character's dice relate to the character and how the information is visually passed down to populate user interface meters. The sequence of events shown in the images are meant to be animated fairly quickly—roughly 2 to 3 seconds—so players playing the product will be able to navigate their visual focus from top screen to bottom screen and initiate the bonus game event. As an example, in one embodiment a battle of some sort is displayed. The player has a character and the computer has a character. The two characters are located in the top screen of a dual screen video slot product. At the bottom of the top screen is a user interface to house the dice that appear on the top screen, while on the bottom screen is where the dice will be copied to in order for the player to have interaction with their dice.

When the roll of the dice is completed, one of three outcomes will occur: the number will be lower than the opponent's number, the number will tie the opponent's number, or the number will exceed the opponent's number (shown in the above image). This is a basic comparison to determine a winning or losing outcome. In the illustrated embodiment, dice are used for this evaluation, however, any number of instruments may be used as a numeric comparison (for example, two rotating wheels with numbers on them (one representing the player's character and one the opponent), two decks of cards, etc.). If the player's number is lower than the gaming device's number, the player loses the competition. If the player's number is higher than the gaming device's number, the player wins. If the player's number ties the computer's number, depending on the rules stipulated, the player can either tie, lose, or win against the gaming device. Player's that tie the gaming device's number will win against the gaming device.

When the battle competition feature is initiated, an opponent's strength is selected from the table shown in FIG. 28 via random number generation (from 1 to 20); this then determines which type of opponent (visually) is shown to the player—Opponent 1, Opponent 2, or Opponent 3. The value that the opponent has is then presented to the player on screen. When the player initiates the roll of the multisided die, a random number is selected. For the purposes of implementation, the number ranges from 1 to 20, but it should be noted that any range of numbers can be chosen, for example 1-6, 1-12, 1-100, etc. Upon selecting the number, the gaming machine compares that value to the value of the opponent's number. For example, the player rolls a 6 and the opponent has a strength value of 8. In certain cases, randomly, an added "power up value" of +0-+4 will be applied to the dice. This occurs if the player's dice value stops near or below the value of the opponent's strength value and needs that extra "push" to try and pass the enemy's value. It should be noted that this power up value will not always be successful when awarded. For example, referring to FIG. 30, let's say the player rolled a 12, but the opponent had a value of 6. Looking the values up in the table above, there would be a 0% chance of a "power up value" being applied to the player's rolled number. In another example, if the player rolled a 5 and the opponent's strength was shown as 8, there would be an "0.38%" chance of a "power up value" being applied.

Then, looking at the record illustrated in FIG. 29, one can see that the chance of the "power up value" being a +0, +1, +2, +3 or +4 are 6.67%, 33.33%, 26.67%, 20.00% and 13.33%, respectively. If the "power up value" is applied to the player's dice value, visually speaking, the sequence of events are the following: The player's die plays a general roll for about a half second. Randomly, an added "power up value" of +1-+3 will be applied to the dice. This occurs if the player's dice value stops near or below the value of the enemy's strength value and needs that extra "push" to try and pass the enemy's value. It should be noted that this power up value will not always be successful when awarded. If applied, the die plays a random segment of counting up from 1 to 3 beats. The count up is a sequential display of numbers to build anticipation for the player. As an example, if the dice would randomly roll and then show 8 . . . Power Up Award! . . . 9 . . . 10, stopping on the 10. At the end of the count up, the final value of the die is shown and the outcome of the animatic is played.

Defeat Fatigue: in one embodiment, the player gets at most 10 battles. On each battle, the RNG decides if the player wins or loses. FIG. 26 depicts the chance the player will end on each round. Thus, there is a 0.002% chance the player will finish all 10 rounds. To alleviate defeat fatigue, the gaming machine 10 provides the player an "end" scenario on the battle before they would lose. For example, if the gaming machine 10 knows the player will lose on battle 3, there's a 30% chance that after battle 2, the gaming machine 10 will "end" the bonus and give the player a prize. It should also be noted that this is adjusted based on bet level (since the higher betting player will have fewer battles to fight).

Jackpot Decision Feature: Upon completion of the Enemy Battle feature, the camera will ascend from its current position to bring the prize wheel into the perspective of a top down view. As this is occurring, the prize wheel continues to slowly rotate along with a pointer that will present itself from out of the game field. As the wheel slowly rotates around its central axis, the bottom screen will display a button that states, "Press to Spin" (located in the center of the bottom display). When the button appears on the bottom screen, the timer will also appear along with the following statement in a window: "THE JACKPOT DECISION FEATURE HAS A _____ SECOND TIME LIMIT. IF THE SPIN BUTTON IS NOT PRESSED TO ACTIVATE THE FEATURE WITHIN _____ SECONDS, THE FEATURE WILL ACTIVATE AUTOMATICALLY." When the button is pressed, it disappears and a banner message is then shown on the bottom screen that states, "Look Up to See Your Award". The wheel then accelerates and then slows to a stop awarding a progressive.

Progressive Presentation: After the wheel spins and stops on a prize, the progressive award will display on both the top and bottom screens. The top screen will only display the progressive level awarded (in text) in the middle of the wheel (appearing similar in style to Dragon's Victory); the bottom screen will display the progressive level awarded (in text) along with the dollar amount awarded of the won progressive level. MINI Presentation: The name MINI shown in the middle of the wheel, held for 3 seconds. MAJOR Presentation: The name MAJOR shown in the middle of the wheel, held for 4 seconds. MEGA Presentation: The name MEGA shown in the middle of the wheel along with an exciting explosion or other effect surrounding the progressive level, held for 5 seconds. MAXI Presentation: The name MAXI shown in the middle of the wheel along with an exciting explosion or effect surrounding the progressive level, held for 5 seconds.

Transition Back to Primary Game: After the prize hold, the game will display a transition to the tally screen where the player's award will be displayed. The top screen will still display the progressive win award level (only) while the bottom screen displays the progressive level win along with any total credit prize(s) awarded in the map picking portion of the bonus. After holding for 5 seconds, the white fade will then be introduced to bring the player back to the primary game screen.

Figure 31:
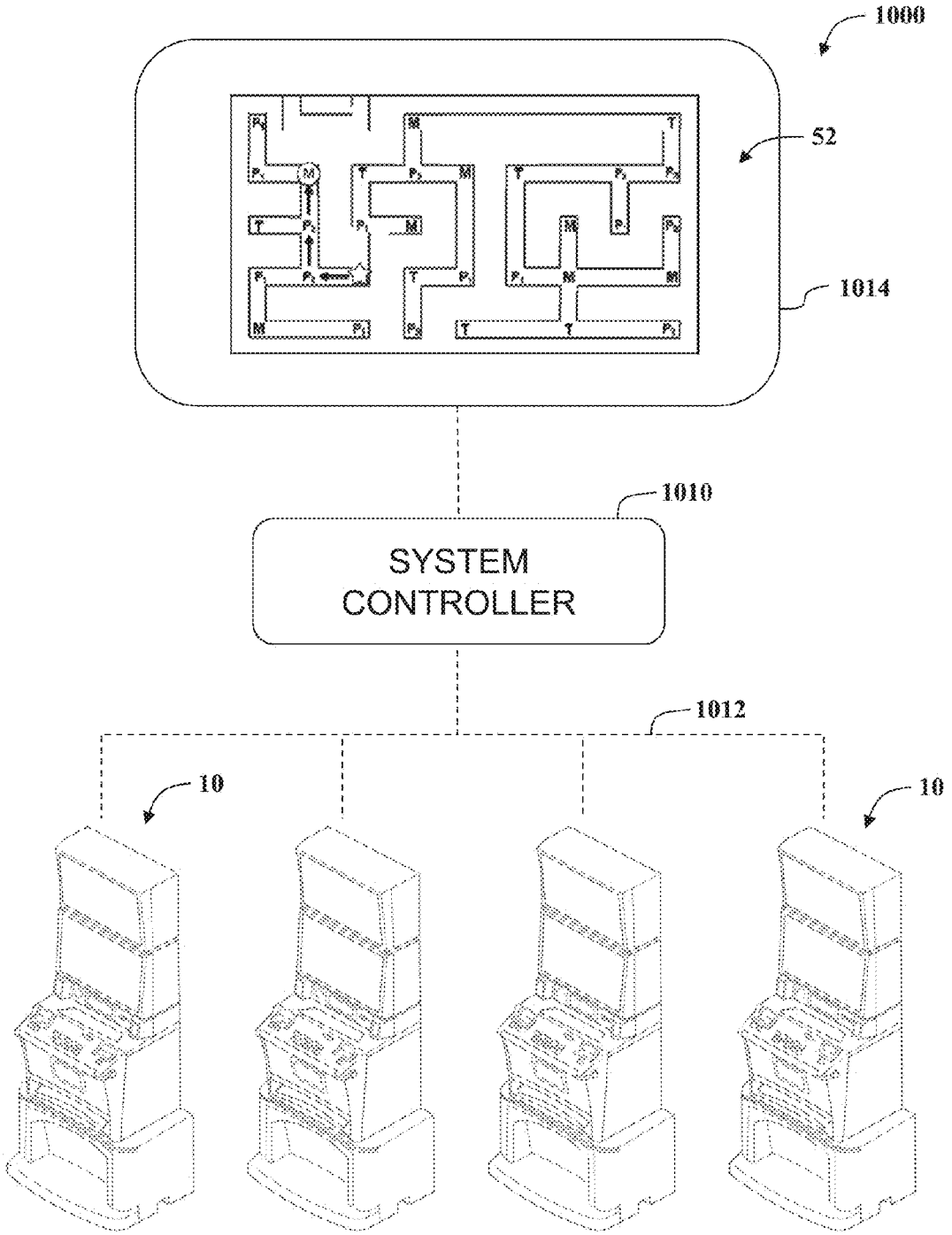
FIG. 31 is a schematic view of a gaming system that may be used for providing an award to a player, according to an embodiment of the present invention.

FIG. 31 is a schematic view of an exemplary gaming system 1000. The gaming system 1000 includes a system controller 1010 and one or more gaming devices 10 that are coupled to the system controller 1010. In one embodiment, the gaming devices 10 include a gaming machine located in a casino. In another embodiment, the gaming devices 10 may include a personal computer, laptop, cell phone, smartphone, tablet computer, personal data assistant, and/or any suitable computing device that enables a player to connect to system controller 1010 via the internet.

In the illustrated embodiment, the system controller 1010 is configured to perform all of the functions of the gaming controller 16 as described herein. The system controller 302 communicates with each gaming device 10 for playing a primary game 62 and/or a secondary game 64 on each gaming device 10 based on user selection input received from each gaming device 10. In the illustrated embodiment, the system controller 1010 plays a separate instance of the games on each gaming device 10 such that each player associated with the gaming devices 10 may play a separate instance of the games simultaneously.

In one embodiment, the system 1000 includes a plurality of gaming machines 10 located in a casino. The gaming machines 10 and the system controller 1010 are coupled in communication with a local area network (LAN) 1012. Alternatively, the gaming machines 10 and the system controller 1010 may be coupled via a network such as, for example, an Internet link, an intranet, a WAN, dial-in-connections, cable modems, wireless modems, and/or ISDN lines. In the illustrated embodiment, the gaming system 1000 includes four gaming machines 10, which in one embodiment as shown in FIG. 31 are arranged in a bank, i.e., are arranged together, adjacently. It should be noted, however, that the gaming system 1000 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 1010. In addition, in the illustrated embodiment, the gaming system 1000 may also include a central display 1014 that is coupled to the system controller 1010 for displaying games played on one or more of the gaming machines 10.

In one embodiment, the system controller 1010 may be implemented by one of the gaming controllers 12 associated with a gaming machine 10. In still another embodiment, the system controller 1010 may be located remotely with respect to gaming machines 10, or within one of the gaming machine cabinet assemblies (shown in FIG. 1).

In the illustrated embodiment, the system controller 1010 may be configured to play separate instances of the primary game 62 on each of the gaming machine 10. In addition, the system controller 1010 may determine if a triggering condition occurs in a game outcome being played at one or more of the gaming machines 10, and display the secondary game 64 on the central display 1014 if a triggering event occurs. Alternatively, the system controller 1010 may display the secondary game 64 at one or more gaming machines 10 based on one or more triggering events occurring in games played at the gaming machines 10.

The above-described system, apparatus, and methods overcome at least some disadvantages of known gaming systems by providing a gaming device that provides a bonus game that allows a player to interact with a player symbol to select one or more bonus awards and that increased the probability of winning an award by providing persistent player positions with subsequent bonus games. Moreover, the gaming device provides a game that includes a plurality of game symbols positioned throughout a game maze and allows a player to move a player symbol through the game maze to acquire game symbols. The gaming device also provides an award to the player as a function of the acquired game symbols. In addition, upon completion of the bonus game, the gaming device stores the current location of the player symbol for use in a subsequent bonus game. By providing a bonus game that includes a plurality of game symbols that are acquired by the player to obtain associated awards, and that stores the location of the corresponding player symbol for use in subsequent games, the probability of the player receiving an award is increased. Thus, the amount of time that the gaming devices are played by patrons of a gaming establishment is thereby increased.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein.

(Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game to a player, comprising:

a display device;

a controller coupled to the display device, the controller configured to:

display a primary game on the display device, the primary game including a plurality of reels and a plurality of symbols being displayed with the plurality of reels;

randomly generate an outcome of the primary game and display the outcome on the display device;

detect a triggering condition occurring with the primary game and responsively display a secondary game on the display device, the secondary game including a player character and an enemy character being displayed on an animated game field;

display a plurality of dice on the animated game field including a player die being displayed with a player strength value and an enemy die being displayed with an enemy strength value;

display an expandable image of the player strength value at a first size and increase the size of the expandable image to a larger second size over a predefined period of time; and determine an outcome of the secondary game as a function of the player strength value and the enemy strength value and responsively provide an award to the player.

2. A gaming machine in accordance with claim 1, the controller configured to:

animate the player die to simulate the player die spinning and stopping to display the player strength value.

3. A gaming machine in accordance with claim 1, the controller configured to:

display the enemy strength value having a predefined size and increase the size of the expandable image to the larger second size that is the same as the predefined size of the enemy strength value.

4. A gaming machine in accordance with claim 1, the controller configured to:

randomly select a first random number from a predefined range of numbers, the first random number being associated with the enemy strength value of the enemy character; and randomly select a second random number from the predefined range of numbers, the second random number being associated with the player strength value of the player character.

5. A gaming machine in accordance with claim 4, the controller configured to:

display the player die having a number of sides equal to an amount of numbers included in the predefined range of numbers, each side of the player die being displayed with a corresponding number included in the predefined range of numbers.

6. A gaming machine in accordance with claim 4, the controller configured to:

select an enemy image being displayed with the enemy character as a function of the enemy strength value, the enemy image being selected from a predefined set of enemy images, each of the enemy images being associated with a subset of the predefined range of numbers.

7. A gaming machine in accordance with claim 1, the controller configured to:

display each side of the player die having a triangular shape, a portion of the expandable image extending beyond a perimeter of a corresponding side of the player die.

8. A gaming machine in accordance with claim 1, the controller configured to:

display an initial image of the player strength value with a side of the player die; and display the expandable image overlaying the initial image of the player strength value and increase a transparency of the expandable image over the predefined period of time such that the initial image is visible through the expandable image.

9. A gaming machine in accordance with claim 1, the controller configured to:

display a request notification to the player to initiate a selection of the player strength value; and randomly select the player strength value and display the selected player strength value on the player die in response to receiving a selection from the player.

10. A gaming machine in accordance with claim 1, the controller configured to:

display a first player die on the animated game field; and display a second player die on a player selection area, the second player die being similar to the first player die and being selectable by the player to initiate a selection of the player strength value.

11. A computer-implemented method of providing a game to a player via a gaming machine including a display device and a gaming controller, including the steps of:

receiving, by a gaming controller, a signal indicating a wager being placed by a player and responsively displaying a primary game on a display device, the primary game including a plurality of reels and a plurality of symbols being displayed with the plurality of reels;

randomly generating, by the gaming controller, an outcome of the primary game and displaying the outcome on the display device;

detecting a triggering condition occurring with the primary game and responsively display a secondary game on the display device, the secondary game including a player character and an enemy character being displayed on an animated game field;

displaying a plurality of dice on the animated game field including a player die being displayed with a player strength value and an enemy die being displayed with an enemy strength value;

displaying an expandable image of the player strength value at a first size and increase the size of the expandable image to a larger second size over a predefined period of time; and determining an outcome of the secondary game as a function of the player strength value and the enemy strength value and responsively provide an award to the player.

12. A method in accordance with claim 11, including the step of animating the player die to simulate the player die spinning and stopping to display the player strength value.

13. A method in accordance with claim 11, including the step of displaying the enemy strength value having a predefined size and increase the size of the expandable image to the larger second size that is the same as the predefined size of the enemy strength value.

14. A method in accordance with claim 11, including the steps of:

randomly selecting a first random number from a predefined range of numbers, the first random number being associated with the enemy strength value of the enemy character; and randomly selecting a second random number from the predefined range of numbers, the second random number being associated with the player strength value of the player character.

15. A method in accordance with claim 14, including the step of displaying the player die having a number of sides equal to an amount of numbers included in the predefined range of numbers, each side of the player die being displayed with a corresponding number included in the predefined range of numbers.

16. A method in accordance with claim 14, including the step of selecting an enemy image being displayed with the enemy character as a function of the enemy strength value, the enemy image being selected from a predefined set of enemy images, each of the enemy images being associated with a subset of the predefined range of numbers.

17. A method in accordance with claim 11, including the step of displaying each side of the player die having a triangular shape, a portion of the expandable image extending beyond a perimeter of a corresponding side of the player die.

18. A method in accordance with claim 11, including the steps of:

displaying an initial image of the player strength value with a side of the player die; and displaying the expandable image overlaying the initial image of the player strength value and increase a transparency of the expandable image over the predefined period of time such that the initial image is visible through the expandable image.

19. A method in accordance with claim 11, including the steps of:

displaying a first player die on the animated game field;

displaying a second player die on a player selection area, the second player die being similar to the first player die and being selectable by the player to initiate a selection of the player strength value;

displaying a request notification to the player to initiate the selection of the player strength value; and randomly selecting the player strength value and display the selected player strength value on the player die in response to receiving a selection from the player.

20. One or more non-transitory computer-readable storage media, having computer-executable instructions embodied thereon, wherein when executed by at least one processor, the computer-executable instructions cause the processor to:

display a primary game on a display device, the primary game including a plurality of reels and a plurality of symbols being displayed with the plurality of reels;

randomly generate an outcome of the primary game and display the outcome on the display device;

detect a triggering condition occurring with the primary game and responsively display a secondary game on the display device, the secondary game including a player character and an enemy character being displayed on an animated game field;

display a plurality of dice on the animated game field including a player die being displayed with a player strength value and an enemy die being displayed with an enemy strength value;

display an expandable image of the player strength value at a first size and increase the size of the expandable image to a larger second size over a predefined period of time; and determine an outcome of the secondary game as a function of the player strength value and the enemy strength value and responsively provide an award to the player.

* * * * *